US012416427B2

(12) United States Patent
Khedekar et al.

(10) Patent No.: US 12,416,427 B2
(45) Date of Patent: Sep. 16, 2025

(54) HOUSING OF AN HVAC SYSTEM

(71) Applicant: Johnson Controls Tyco IP Holdings LLP, Milwaukee, WI (US)

(72) Inventors: Amol V. Khedekar, Pune (IN); Robert A. Amick, York, PA (US); Shivchandra V. Nagime, Latur (IN); Henry L. Urey, York, PA (US); Mahantesh Honnamane, Pune (IN)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 903 days.

(21) Appl. No.: 17/489,430

(22) Filed: Sep. 29, 2021

(65) Prior Publication Data

US 2022/0099333 A1 Mar. 31, 2022

(51) Int. Cl.

| | |
|---|---|
| ***F24F 13/20*** | (2006.01) |
| ***F24F 3/044*** | (2006.01) |
| ***F24F 7/007*** | (2006.01) |
| *F24F 7/06* | (2006.01) |

(52) U.S. Cl.

CPC ..... *F24F 13/20* (2013.01); *F24F 3/0442* (2013.01); *F24F 7/007* (2013.01); *F24F 7/06* (2013.01); *F24F 2221/36* (2013.01)

(58) Field of Classification Search

CPC ..... F24F 13/20; F24F 3/0442; F24F 7/007; F24F 2221/36; F24F 3/044; F24F 13/0209; E04B 1/3483

See application file for complete search history.

(56) References Cited

U.S. PATENT DOCUMENTS

| | | | | |
|---|---|---|---|---|
| 7,334,377 | B2 | 2/2008 | Dubensky et al. | |
| 2004/0063398 | A1 | 4/2004 | Beser et al. | |
| 2005/0084324 | A1* | 4/2005 | Dubensky | E04B 1/3483 403/305 |
| 2011/0291533 | A1* | 12/2011 | McFarland | F24F 13/20 312/236 |

OTHER PUBLICATIONS

Alarko Carrier, 39 HQ Air Handling Units AiroVision, Assembly/Installation, Commissioning, Maintenance Manual, Aug. 10, 2018, 52 pages.

* cited by examiner

*Primary Examiner* — Frantz F Jules
*Assistant Examiner* — Martha Tadesse
(74) *Attorney, Agent, or Firm* — Fletcher Yoder, PC

(57) ABSTRACT

A frame segment for a frame of a heating, ventilation, and/or air conditioning (HVAC) system includes a protrusion formed on an interior side of the frame segment and configured to engage with a first panel of the HVAC system, a first recess formed at an exterior side, opposite the interior side, of the frame segment, and a second recess formed at the exterior side of the frame segment. The first recess is configured to receive a second panel of the HVAC system, and the second recess is configured to receive a third panel of the HVAC system.

10 Claims, 13 Drawing Sheets

HOUSING OF AN HVAC SYSTEM

CROSS-REFERENCE TO RELATED APPLICATION

This application claims priority from and the benefit of India Provisional Application No. 202011042331, entitled "MULLION STRUCTURE FOR AN AIR HANDLING UNIT," filed Sep. 29, 2020, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. In certain embodiments, the HVAC system may include a housing or an enclosure, which may include segments, panels, connectors, and so forth that may be assembled to define an interior volume of the HVAC system. Unfortunately, traditional housings may be difficult to manufacture in a desirable manner, such as to include a desirable arrangement of compartments or sections. Thus, manufacture of an HVAC system may be difficult, expensive, and/or time consuming, and/or a functionality of the HVAC system may be limited.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a frame segment for a frame of a heating, ventilation, and/or air conditioning (HVAC) system includes a protrusion formed on an interior side of the frame segment and configured to engage with a first panel of the HVAC system, a first recess formed at an exterior side, opposite the interior side, of the frame segment, and a second recess formed at the exterior side of the frame segment. The first recess is configured to receive a second panel of the HVAC system, and the second recess is configured to receive a third panel of the HVAC system.

In one embodiment, a frame structure of a heating, ventilation, and/or air conditioning (HVAC) system includes a frame segment having a protrusion formed on a first side of the frame segment and having a first recess and a second recess formed on a second side, opposite the first side, of the frame segment. The frame structure also includes a frame connector configured to couple to the frame segment.

In one embodiment, a housing for a heating, ventilation, and/or air conditioning (HVAC) system includes a frame structure having a frame segment. The frame segment includes a protrusion formed on a first side of the frame segment, a first recess formed on a second side, opposite the first side, of the frame segment, and a second recess formed on the second side of the frame segment. The housing also includes a plurality of housing panels. A first housing panel of the plurality of housing panels is configured to couple to the protrusion of the frame segment, a second housing panel of the plurality of housing panels is configured to be disposed within the first recess of the frame segment, and a third housing panel of the plurality of housing panels is configured to be disposed within the second recess of the frame segment

DRAWINGS

Various aspects of this disclosure may be better understood upon reading the following detailed description and upon reference to the drawings in which.

Figure 14:
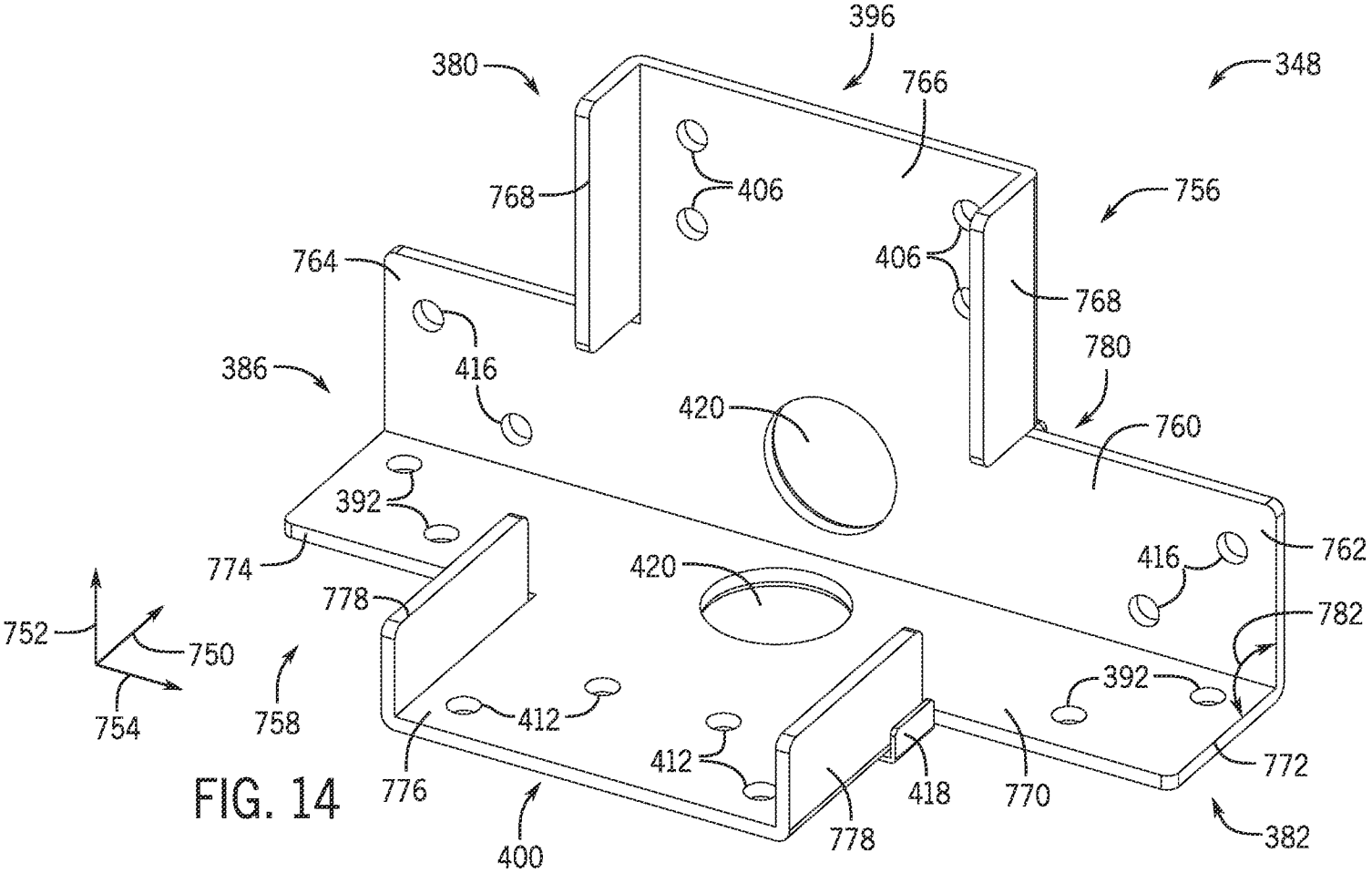
Figure 15:
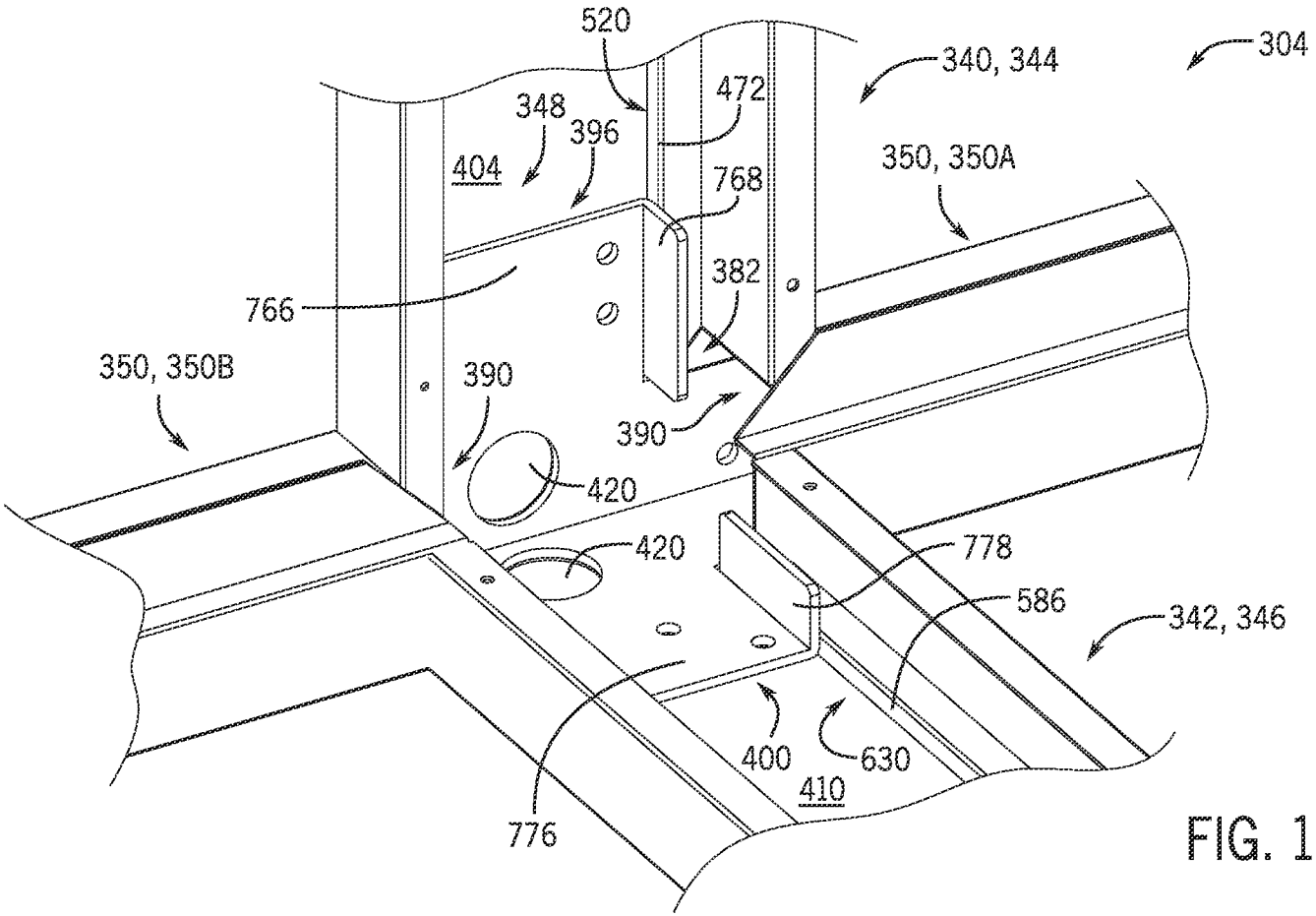
Figure 16:
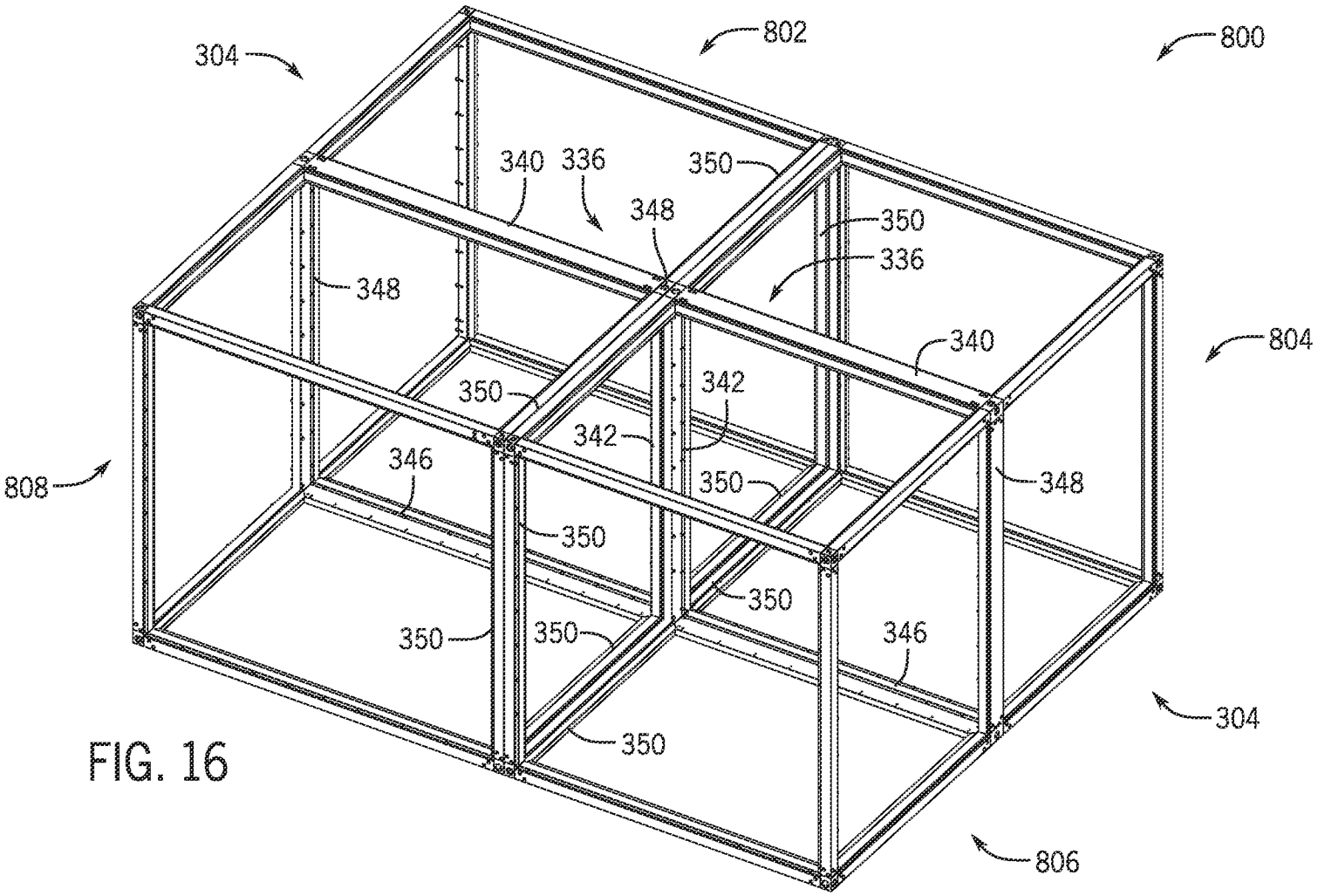

FIG. 14 is a perspective view of an embodiment of a connector configured to be incorporated in a frame structure of a housing for an HVAC system, in accordance with an aspect of the present disclosure FIG. 15 is a detailed perspective view of an embodiment of a frame structure of a housing for an HVAC system, in accordance with an aspect of the present disclosure; and FIG. 16 is a perspective view of an embodiment of a frame structure of a housing for an HVAC system, in accordance with an aspect of the present disclosure.

DETAILED DESCRIPTION

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may be configured to condition an air flow and to deliver the air flow to a space serviced by the HVAC system to condition the space. As an example, the HVAC system may include a vapor compression circuit configured to circulate a refrigerant, cool the refrigerant via a condenser, place the cooled refrigerant in a heat exchange relationship with the air flow to cool the air flow (e.g., via an evaporator), and deliver the air flow to the space to cool the space. As another example, the HVAC system may be configured to heat the air flow, such as via a furnace, and deliver the air flow to the space to heat the space.

The HVAC system may include a housing or an enclosure configured to contain various components and devices (e.g., the condenser, the evaporator) and shield the components from an exterior environment, such as an ambient environment. For example, the housing may include a frame structure and panels that cooperatively define an interior volume in which the components may be disposed. However, the frame structure for housings of traditional or conventional design may not be easily arranged, configured, and/or modified to define the interior volume as desired, such as to form a particular number of sections or compartments and/or sections or compartments of a particular size. Thus, the arrangement of the frame structure may have various limitations, which may limit certain functionalities of the HVAC system. Indeed, it may be difficult to manufacture a housing with multiple sections using components of conventional frame structures.

Thus, it is presently recognized that improvements associated with manufacture of the housing are needed. Accordingly, embodiments of the present disclosure are directed to connectors (e.g., frame connectors) and segments (e.g., frame segments) configured to couple to one another to form a frame structure that may define multiple sections of the housing in an assembled configuration. For example, multiple peripheral frame assemblies defining respective housing sections may be configured to couple to an intermediate frame assembly of the frame structure. Each of the peripheral frame assemblies may define a respective housing section. Thus, the frame structure may include multiple housing sections that are integral with one another in an assembled configuration. In some embodiments, the intermediate frame assembly may include intermediate frame connectors and intermediate frame segments configured to couple to the intermediate frame connectors, and the peripheral frame assembly may include peripheral frame connectors and peripheral frame segments configured to couple to both the peripheral frame connectors and the intermediate frame connectors. Each of the intermediate frame segments may have a profile to enable the intermediate frame segment to couple to at least three panels (e.g., housing panels) of the HVAC system. Additionally, each of the intermediate frame connectors may have a profile to enable the intermediate frame connector to couple to multiple peripheral frame segments and multiple intermediate frame segments. The arrangement of the frame structure to define multiple housing sections integral with one another may improve manufacture and/or operation of HVAC systems. By way of example, one of the housing sections may include an air handling unit (AHU) and another of the housing sections may include a vestibule. The air handling unit may enclose different components that enable operation of the HVAC system to condition an air flow, and the integral coupling between the AHU and the vestibule may enable certain components of the AHU to be accessible to a user (e.g., a technician, an operator) via the vestibule. For example, the vestibule may be an enclosed housing section that defines a protected interior space configured to accommodate an operator or technician and enable access to components of the AHU. In this manner, the frame structure may improve access to various components of the HVAC system, such as for servicing the HVAC system, thereby improving performance of the HVAC system. However, it should be noted that the frame structure may enable manufacture of an HVAC system having housing sections for enabling any suitable functionality.

Figure 1:
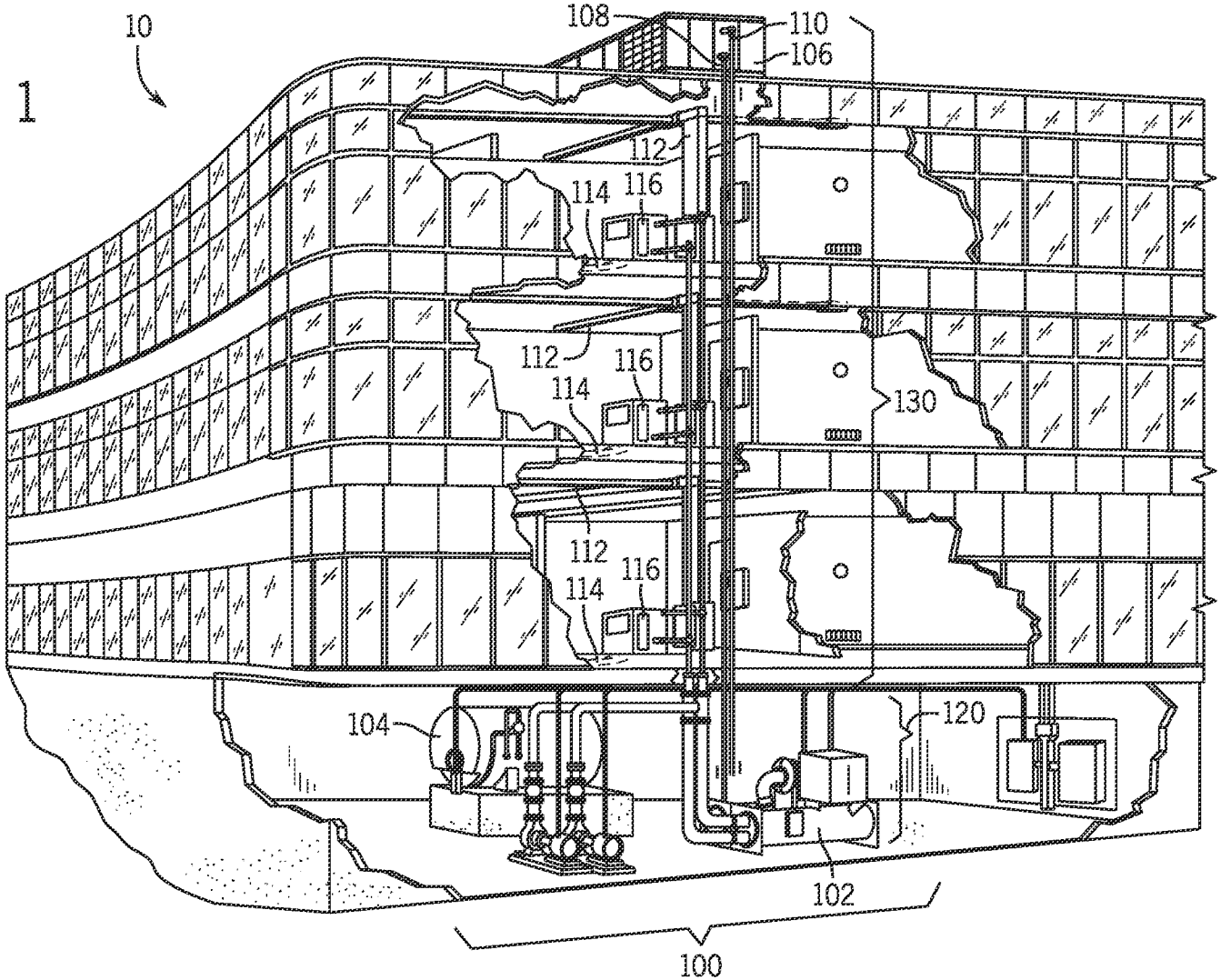
FIG. 1 is a perspective view of a building including a heating, ventilating, or air conditioning (HVAC) system, in accordance with an aspect of the present disclosure.

Referring now to FIG. 1, a perspective view of a building 10 is shown. The building 10 is served by a heating, ventilating, or air conditioning (HVAC) system 100. The HVAC system 100 can include a plurality of HVAC devices (e.g., heaters, chillers, air handling units, pumps, fans, thermal energy storage) configured to provide heating, cooling, air conditioning, ventilation, and/or other services for the building 10. For example, the HVAC system 100 is shown to include a waterside system 120 and an airside system 130. The waterside system 120 may provide a heated or chilled fluid to an air handling unit of the airside system 130. The airside system 130 may use the heated or chilled fluid to heat or cool an airflow provided to the building 10.

The HVAC system 100 is shown to include a chiller 102, a boiler 104, and a rooftop AHU 106. The waterside system 120 may use the boiler 104 and the chiller 102 to heat or cool a working fluid (e.g., water, glycol) and may circulate the working fluid to the AHU 106. In various embodiments, the HVAC devices of the waterside system 120 can be located in or around the building 10 (as shown in FIG. 1) or at an offsite location such as a central plant (e.g., a chiller plant, a steam plant, a heat plant) that serves one or more buildings including the building 10. The working fluid can be heated in the boiler 104 or cooled in the chiller 102, depending on whether heating or cooling is required in the building 10. The boiler 104 may add heat to the circulated fluid, for example, by burning a combustible material (e.g., natural gas) or using an electric heating element. The chiller 102 may place the circulated fluid in a heat exchange relationship with another fluid (e.g., a refrigerant) in a heat exchanger (e.g., an evaporator) to absorb heat from the circulated fluid. The working fluid from the chiller 102 and/or the boiler 104 can be transported to the AHU 106 via piping 108.

The AHU 106 may place the working fluid in a heat exchange relationship with an airflow passing through the AHU 106 (e.g., via one or more stages of cooling coils and/or heating coils). The airflow can be, for example, outside air, return air from within the building 10, or a combination of both. The AHU 106 may transfer heat between the airflow and the working fluid to provide heating or cooling for the airflow. For example, the AHU 106 can include one or more fans or blowers configured to pass the airflow over or through a heat exchanger containing the working fluid. The working fluid may then return to the chiller 102 or the boiler 104 via piping 110.

The airside system 130 may deliver the airflow supplied by the AHU 106 (i.e., the supply airflow) to the building 10 via air supply ducts 112 and may provide return air from the building 10 to the AHU 106 via air return ducts 114. In some embodiments, the airside system 130 includes multiple variable air volume (VAV) units 116. For example, the airside system 130 is shown to include a separate VAV unit 116 on each floor or zone of the building 10. The VAV units 116 can include dampers or other flow control elements that can be operated to control an amount of the supply airflow provided to individual zones of the building 10. In other embodiments, the airside system 130 delivers the supply airflow into one or more zones of the building 10 (e.g., via the supply ducts 112) without using intermediate VAV units 116 or other flow control elements. The AHU 106 can include various sensors (e.g., temperature sensors, pressure sensors) configured to measure attributes of the supply airflow. The AHU 106 may receive input from sensors located within the AHU 106 and/or within the building zone and may adjust the flow rate, temperature, or other attributes of the supply airflow through the AHU 106 to achieve setpoint conditions for the building zone.

Figure 2:
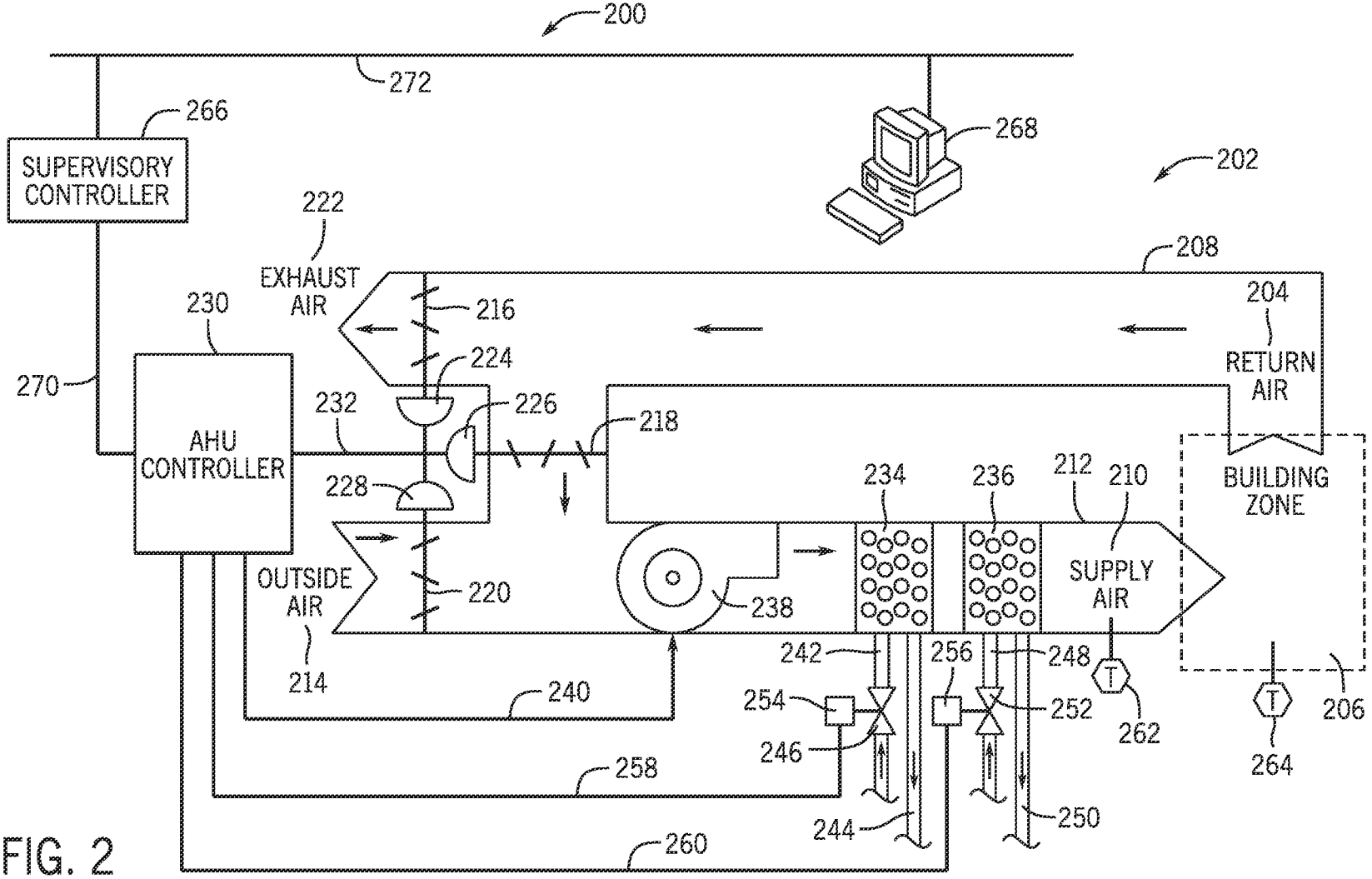
FIG. 2 is a block diagram of an airside system including an air handling unit (AHU) which can be used in the HVAC system of FIG. 1, in accordance with an aspect of the present disclosure.

Referring now to FIG. 2, a block diagram of an airside system 200 is shown, according to some embodiments. In various embodiments, the airside system 200 may supplement or replace the airside system 130 in the HVAC system 100 or can be implemented separate from the HVAC system 100. When implemented in the HVAC system 100, the airside system 200 can include a subset of the HVAC devices in the HVAC system 100 (e.g., AHU 106, VAV units 116, ducts 112-114, fans, dampers) and can be located in or around the building 10. The airside system 200 may operate to heat or cool an airflow provided to the building 10 using a heated or chilled fluid provided by the waterside system 120.

In FIG. 2, the airside system 200 is shown to include an AHU 202. Economizer-type AHUs vary the amount of outside air and return air used by the air handling unit for heating or cooling. For example, the AHU 202 may receive return air 204 from a building zone 206 via a return air duct 208 and may deliver supply air 210 to the building zone 206 via a supply air duct 212. In some embodiments, the AHU 202 is a rooftop unit located on the roof of the building 10 (e.g., the AHU 106 as shown in FIG. 1) or otherwise positioned to receive both the return air 204 and outside air 214. The AHU 202 can be configured to operate an exhaust air damper 216, a mixing damper 218, and an outside air damper 220 to control an amount of the outside air 214 and the return air 204 that combine to form the supply air 210. Any return air 204 that does not pass through the mixing damper 218 can be exhausted from the AHU 202 through the exhaust damper 216 as exhaust air 222.

Each of the dampers 216-220 can be operated by an actuator. For example, the exhaust air damper 216 can be operated by an actuator 224, the mixing damper 218 can be operated by an actuator 226, and the outside air damper 220 can be operated by an actuator 228. The actuators 224-228 may communicate with an AHU controller 230 via a communications link 232. The actuators 224-228 may receive control signals from the AHU controller 230 and may provide feedback signals to the AHU controller 230. Feedback signals can include, for example, an indication of a current actuator or damper position, an amount of torque or force exerted by the actuator, diagnostic information (e.g., results of diagnostic tests performed by the actuators 224-228), status information, commissioning information, configuration settings, calibration data, and/or other types of information or data that can be collected, stored, or used by the actuators 224-228. The AHU controller 230 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms) to control the actuators 224-228.

Still referring to FIG. 2, the AHU 202 is shown to include a cooling coil 234, a heating coil 236, and a fan 238 positioned within the supply air duct 212. The fan 238 can be configured to force the supply air 210 through the cooling coil 234 and/or the heating coil 236 and provide the supply air 210 to the building zone 206. The AHU controller 230 may communicate with the fan 238 via a communications link 240 to control a flow rate of the supply air 210. In some embodiments, the AHU controller 230 controls an amount of heating or cooling applied to the supply air 210 by modulating a speed of the fan 238.

The cooling coil 234 may receive a chilled fluid from the waterside system 120 (via piping 242) and may return the chilled fluid to the waterside system 120 via piping 244. A valve 246 can be positioned along the piping 242 or the piping 244 to control a flow rate of the chilled fluid through the cooling coil 234. In some embodiments, the cooling coil 234 includes multiple stages of cooling coils that can be independently activated and deactivated (e.g., by the AHU controller 230, by a supervisory controller 266) to modulate an amount of cooling applied to the supply air 210.

The heating coil 236 may receive a heated fluid from the waterside system 120 via piping 248 and may return the heated fluid to the waterside system 120 via piping 250. A valve 252 can be positioned along the piping 248 or the piping 250 to control a flow rate of the heated fluid through the heating coil 236. In some embodiments, the heating coil 236 includes multiple stages of heating coils that can be independently activated and deactivated (e.g., by the AHU controller 230, by the supervisory controller 266) to modulate an amount of heating applied to the supply air 210.

Each of the valves 246, 252 can be controlled by an actuator. For example, the valve 246 can be controlled by an actuator 254, and the valve 252 can be controlled by an actuator 256. The actuators 254, 256 may communicate with the AHU controller 230 via communications links 258, 260. The actuators 254 and 256 may receive control signals from the AHU controller 230 and may provide feedback signals to the AHU controller 230. In some embodiments, the AHU controller 230 receives a measurement of the supply air temperature from a temperature sensor 262 positioned in the supply air duct 212 (e.g., downstream of the cooling coil 234 and/or the heating coil 236). The AHU controller 230 may also receive a measurement of the temperature of the building zone 206 from a temperature sensor 264 located in the building zone 206.

In some embodiments, the AHU controller 230 operates the valves 246 and 252 via the actuators 254, 256 to modulate an amount of heating or cooling provided to the supply air 210 (e.g., to achieve a setpoint temperature for the supply air 210 or to maintain the temperature of the supply air 210 within a setpoint temperature range). The positions of the valves 246, 252 affect the amount of heating or cooling provided to the supply air 210 by the cooling coil 234 or the heating coil 236 and may correlate with the amount of energy consumed to achieve a desired supply air temperature. The AHU controller 230 may control the temperature of the supply air 210 and/or the building zone 206 by activating or deactivating the coils 234, 236, adjusting a speed of the fan 238, or a combination of both. While the illustrated embodiment is configured to enable heating and cooling of the supply air 210 via fluids received from the waterside system 120, it should be appreciated that additional or alternative embodiments of the AHU 202 may include a vapor compression circuit (e.g., a refrigerant circuit), a furnace, and/or other components configured to heat and/or cool the supply air 210.

Still referring to FIG. 2, the airside system 200 is shown to include the supervisory controller 266 and a client device 268. The supervisory controller 266 can include one or more computer systems (e.g., servers, supervisory controllers, subsystem controllers) that serve as system level controllers, application or data servers, head nodes, or master controllers for the airside system 200, the waterside system 120, the HVAC system 100, and/or other controllable systems that serve the building 10. The supervisory controller 266 may communicate with multiple downstream building systems or subsystems (e.g., the HVAC system 100, a security system, a lighting system, the waterside system 120) via a communications link 270 according to like or disparate protocols (e.g., LON, BACnet). In various embodiments, the AHU controller 230 and the supervisory controller 266 can be separate (as shown in FIG. 2) or integrated. In an integrated implementation, the AHU controller 230 can be a software module configured for execution by processing circuitry of the supervisory controller 266.

In some embodiments, the AHU controller 230 receives information from the supervisory controller 266 (e.g., commands, setpoints, operating boundaries) and provides information to the supervisory controller 266 (e.g., temperature measurements, valve or actuator positions, operating statuses, diagnostics). For example, the AHU controller 230 may provide the supervisory controller 266 with temperature measurements from the temperature sensors 262, 264, equipment on/off states, equipment operating capacities, and/or any other information that can be used by the supervisory controller 266 to monitor or control a variable state or condition within the building zone 206.

The client device 268 can include one or more human-machine interfaces or client interfaces (e.g., graphical user interfaces, reporting interfaces, text-based computer interfaces, client-facing web services, web servers that provide pages to web clients) for controlling, viewing, or otherwise interacting with the HVAC system 100, its subsystems, and/or devices. The client device 268 can be a computer workstation, a client terminal, a remote or local interface, or any other type of user interface device. The client device 268 can be a stationary terminal or a mobile device. For example, the client device 268 can be a desktop computer, a computer server with a user interface, a laptop computer, a tablet, a smartphone, a PDA, or any other type of mobile or non-mobile device. The client device 268 may communicate with the supervisory controller 266 and/or the AHU controller 230 via communications link 272.

The present disclosure is directed to a housing of an HVAC system, such as a housing of the HVAC system 100. The housing may include a frame structure having frame connectors and frame segments coupled to one another to define multiple housing sections of the HVAC system, such as housing sections that are integrated with, directly coupled to, or extending from one another. The profile of the frame connectors and frame segments may increase flexibility, ease, and/or efficiency of manufacture of the housing, such as to define a suitable number and/or size of the housing sections. Thus, the frame structure described herein may improve the manufacture and/or functionality of the HVAC system.

Figure 3:
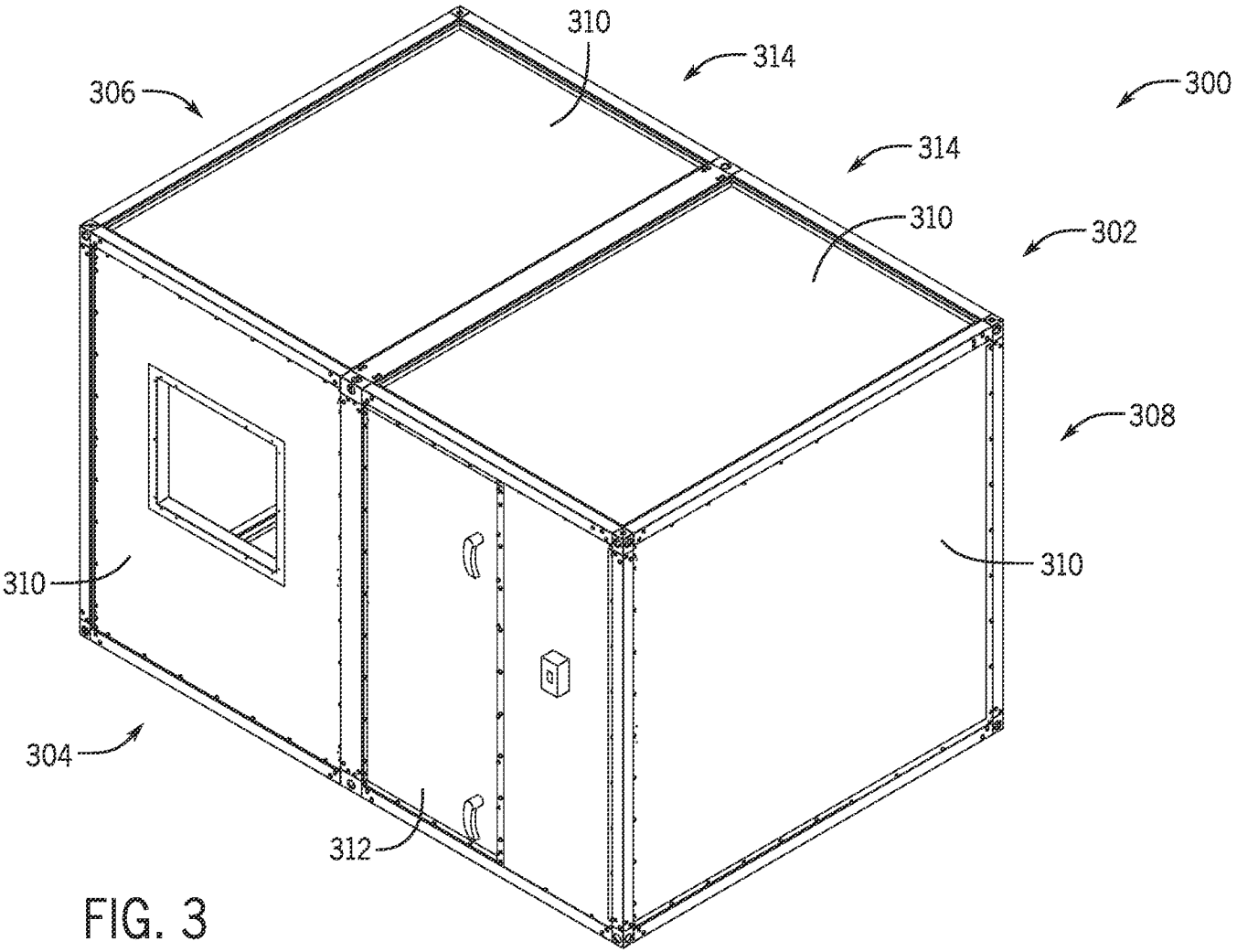
FIG. 3 is a perspective view of an embodiment of an HVAC system having a housing, in accordance with an aspect of the present disclosure.

With this in mind, FIG. 3 is a perspective view of an HVAC system 300 that includes a housing or enclosure 302 having a frame structure 304 (e.g., frame, a housing frame, an enclosure frame). In the illustrated embodiment, the frame structure 304 includes a first housing section 306, which may be an AHU (e.g., the AHU 106), and a second housing section 308, which may be a vestibule. Each of the housing sections 306, 308 may define a respective interior volume within the housing 302, and the housing sections 306, 308 may be integral with (e.g., directly coupled to) one another. Furthermore, the housing 302 may include a plurality of housing panels 310 coupled to the frame structure 304 and configured to shroud or enclose the interior volumes of the housing sections 306, 308 from an external (e.g., ambient) environment. For instance, the housing panels 310 may shield the interior volumes from external elements, such as a temperature, precipitation, debris, and so forth.

By way of example, the first housing section 306 may include, contain, and/or enclose components, such as a compressor, an evaporator, a condenser, a burner, a fan, and so forth, disposed in the interior volume and configured to operate to condition an air flow directed through the first housing section 306. In some embodiments, the first housing section 306 may define the supply air duct 212 and may include the cooling coil 234, the heating coil 236, and/or the fan 238 discussed above with reference to FIG. 2. Indeed, the first housing section 306 may be fluidly coupled to ductwork (e.g., the air supply ducts 112, the air return ducts 114) to enable the air flow to be directed from the housing 302 into a space and/or from the space into the housing 302. For example, the first housing section 306 may include an opening 311 that may be configured to fluidly couple to the ductwork. The second housing section 308 may enable access to one or more of the components disposed within the first housing section 306. For instance, an interior panel, an interior wall, an interior partition, an interior divider, and/or an interior door may be disposed within the housing 302

(e.g., coupled to the frame structure 304) between the first housing section 306 and the second housing section 308.

The second housing section 308 may enable a user to adjust (e.g., open) the interior panel to access the interior volume of the first housing section 306. For example, the second housing section 308 may include an external door 312 (e.g., access panel) that is adjustable to enable access to the interior volume of the second housing section 308. Upon opening the external door 312, the user may access the interior volume of the second housing section 308 and thereby access the interior panel within the housing 302 to access the interior volume of the first housing section 306. For instance, the external door 312 may enable access to the interior volume of the first housing section 306 while the housing panels 310 remain attached at the first housing section 306. In this way, the user may access the components disposed within the first housing section 306 while such components are shielded by the housing panels 310 and are in operation. The second housing section 308 may also shield the user from certain elements of the external environment (e.g., during inclement weather) while the user accesses any of the interior volumes within the housing 302. As an example, a size of the interior volume defined by the second housing section 308 may at least partially accommodate the user. As such, the illustrated housing 302 may help the user perform various tasks associated with the HVAC system 300, such as maintenance and service of the HVAC system 300. In some embodiments, certain components of the HVAC system 300 may also be disposed within the second housing section 308. By way of example, the second housing section 308 may be configured to enclose and shield electronic components (e.g., wiring), piping or coil connections (e.g., connections to components disposed within the first housing section 306), and the like. Thus, the user may also open the external door 312 to access such components disposed in the second housing section 308.

It should be noted that in additional or alternative embodiments, the first housing section 306 and the second housing section 308 may include any suitable section of the HVAC system 300. For example, the housing sections 306, 308 may be used for any suitable purpose and/or may contain any suitable components of the HVAC system 300. Further still, in one or more embodiments, the interior panel may not be disposed between the housing sections 306, 308 or otherwise may not fully separate the first housing section 306 and the second housing section 308 from one another. Thus, the respective interior volumes of the first housing section 306 and the second housing section 308 may remain at least partially continuous with one another.

Figure 4:
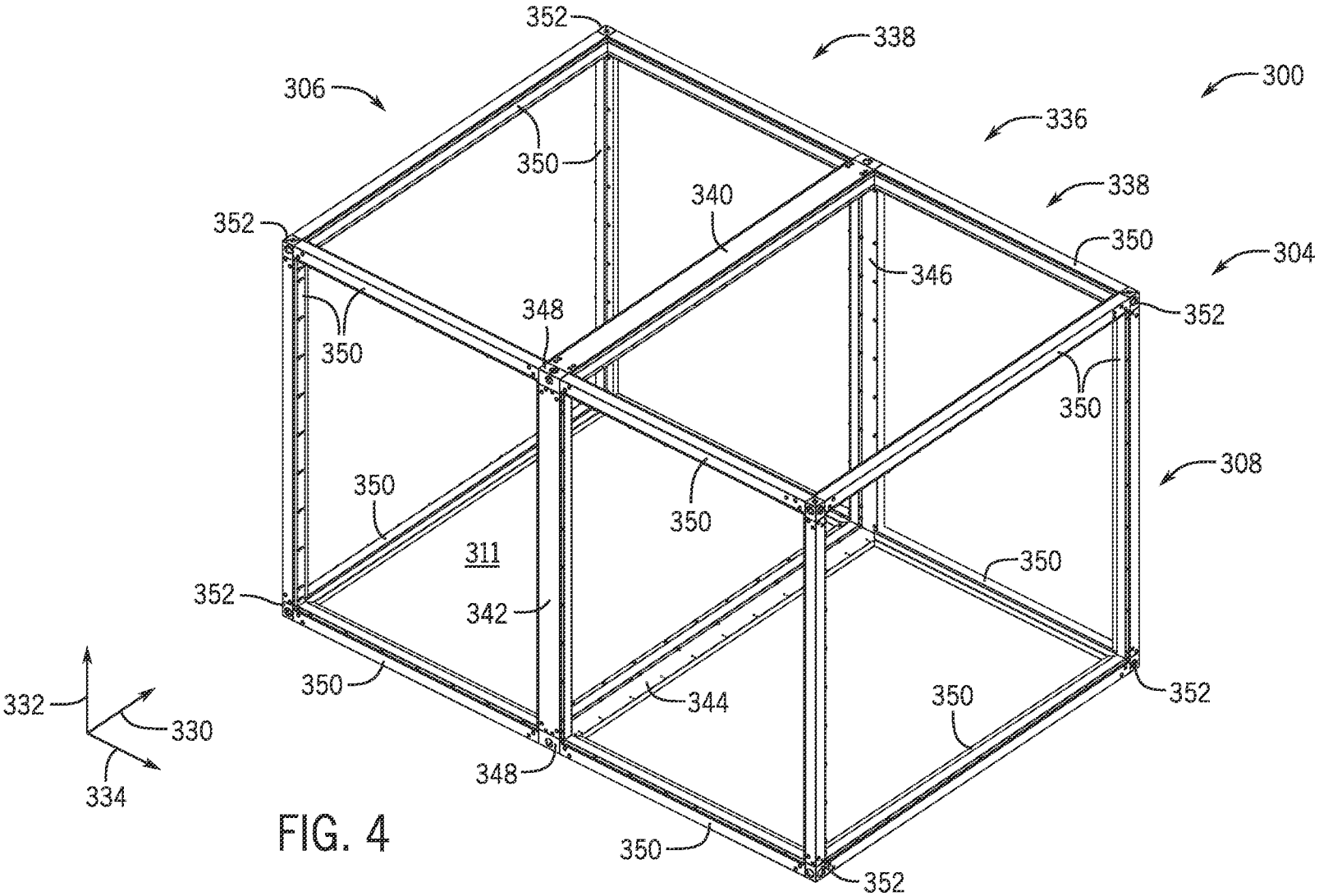
FIG. 4 is a perspective view of an embodiment of a frame structure of a housing for an HVAC system, in accordance with an aspect of the present disclosure.

FIG. 4 is a perspective view of an embodiment of the frame structure 304 of the housing 302. To facilitate discussion, the frame structure 304 and its components will be described with reference to a longitudinal axis or direction 330, a vertical axis or direction 332, and a lateral axis or direction 334 with respect to an orientation of the HVAC system 300. The frame structure 304 may include an intermediate frame assembly 336 (e.g., intermediate assembly) configured to couple adjacent peripheral frame assemblies 338 with one another to define the housing sections 306, 308 and the housing 302. As an example, the intermediate frame assembly 336 may include a first intermediate frame segment or mullion 340 (e.g., a top frame segment, a horizontal frame segment), a second intermediate frame segment or mullion 342 (e.g., a front frame segment, a downstream frame segment, a last-in-airstream frame segment, a vertical frame segment), a third intermediate frame segment or mullion 344 (e.g., a bottom frame segment, a horizontal frame segment), and a fourth intermediate frame segment or mullion 346 (e.g., a rear frame segment, an upstream frame segment, a first-in-airstream segment, a vertical frame segment). Each of the intermediate frame segments 340, 342, 344, 346 may be configured to couple to one another via intermediate frame connectors 348 (e.g., mullion connectors). That is, the intermediate frame segments 340, 342, 344, 346 may be fastened, secured, or otherwise attached (e.g., directly) to one or more intermediate frame connectors 348. For example, the first intermediate frame segment 340 may be coupled to the second intermediate frame segment 342 via a first intermediate frame connector 348, the second intermediate frame segment 342 may be coupled to the third intermediate frame segment 344 via a second intermediate frame connector 348, the third intermediate frame segment 344 may be coupled to the fourth intermediate frame segment 346 via a third intermediate frame connector 348, and the fourth intermediate frame segment 346 may be coupled to the first intermediate frame segment 340 via a fourth intermediate frame connector 348.

Each of the peripheral frame assemblies 338 may include a plurality of peripheral frame segments or raceways 350 coupled to one another via peripheral frame connectors 352. The intermediate frame assembly 336 and the peripheral frame assemblies 338 may cooperatively define the housing sections 306, 308. In the illustrated embodiment, each of the peripheral frame connectors 352 is coupled to three peripheral frame segments 350 extending crosswise to one another (e.g., along the axes 330, 332, 334). Additionally, each of the intermediate frame connectors 348 is configured to couple to a pair of peripheral frame segments 350 (e.g., extending along the lateral axis 334), such as respective peripheral frame segments 350 partially defining each of the housing sections 306, 308. In this manner, the intermediate frame assembly 336 may also partially define both the first housing section 306 and the second housing section 308.

As further discussed herein, each of the frame segments 340, 342, 344, 346, 350 may have a profile (e.g., geometry, configuration) configured to enable coupling to one or more of the housing panels 310. Additionally, in an assembled configuration of the intermediate frame assembly 336, the intermediate frame segments 340, 342, 344, 346 may be configured to cooperatively receive (e.g., accommodate, align with) the interior panel disposed between the housing sections 306, 308 to separate the housing sections 306, 308 from one another. In some embodiments, each of the intermediate frame segments 340, 342, 344, 346 may have a different profile (e.g., geometry, configuration) than that of the peripheral frame segments 350. Furthermore, a subset of the intermediate frame segments (e.g., the first intermediate frame segment 340 and the third intermediate frame segment 344) may have a different profile than that of another subset of the intermediate frame segments (e.g., the second intermediate frame segment 342 and the fourth intermediate frame segment 346). Such profiles may have features and/or dimensions to facilitate coupling the frame segments 340, 342, 344, 346, 350, the frame connectors 348, 352, and the housing panels 310 with one another.

The frame structure 304 may enable greater flexibility and configurability to form any suitable number of housing sections for the HVAC system 300. For example, in certain embodiments, the frame structure 304 may include multiple intermediate frame assemblies 336 to define more than two housing sections 306, 308. An embodiment having two intermediate frame assemblies 336 may include peripheral frame segments 350 that couple to and extend between respective intermediate frame connectors 348 of the intermediate frame assemblies 336. Furthermore, differently sized frame segments 340, 342, 344, 346, 350 may be selected to define a size of the interior volumes of the housing sections of the housing 302. For example, shorter frame segments may be selected to reduce a dimension of any of the interior volumes, longer frame segments may be selected to increase a dimension of any of the interior volumes, and so forth. Indeed, the first housing section 306 may be larger than the second housing section 308, the first housing section 306 may be smaller than the second housing section 308, or the first housing section 306 and the second housing section 308 may be approximately the same size. While the frame segments 340, 342, 344, 346, 350 may have different lengths, frame segments 340, 342, 344, 346, 350 of a common type (e.g., intermediate frame segments 340, 344, intermediate frame segments 342, 346, or peripheral frame segment 350) may still have a common profile, shape or configuration. Thus, a common design or configuration of each type of frame segment 340, 342, 344, 346, 350 may be manufactured and then cut according to a desired size (e.g., length). In this way, the frame segments 340, 342, 344, 346, 350 and the frame connectors 348, 352 may increase flexibility and efficiency associated with manufacture and/or assembly of the frame structure 304. That is, multiple different embodiments of the housing 302 may be manufactured via the frame segments 340, 342, 344, 346, 350 and frame connectors 348, 352. Further still, although the illustrated housing 302 has a rectangular geometry, the HVAC system 300 may have any suitably shaped housing 302, such as any suitably shaped frame structure 304 and/or housing sections 306, 308 formed from the frame segments 340, 342, 344, 346, 350 and frame connectors 348, 352.

Figure 5:
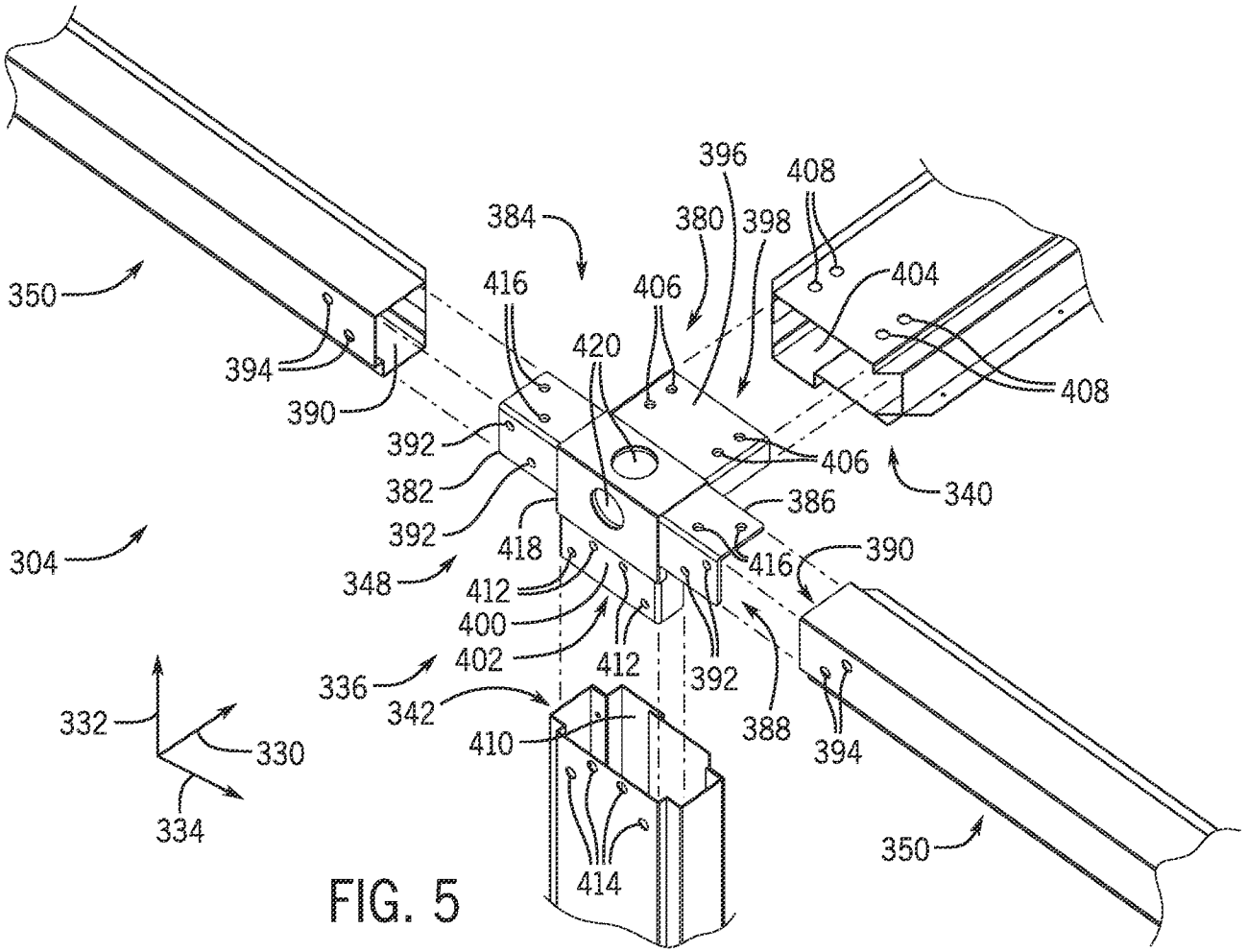
FIG. 5 is a detailed exploded view of an embodiment of a frame structure of a housing for an HVAC system, in accordance with an aspect of the present disclosure.

FIG. 5 is a detailed, exploded view of an embodiment of the frame structure 304 of the housing 302. The illustrated embodiment includes one of the intermediate frame connectors 348 configured to couple to the first intermediate frame segment 340 the second intermediate frame segment 342, and two of the peripheral frame segments 350. By way of example, the intermediate frame connector 348 may include a bracket 380 that has a first peripheral extension 382 extending from a first side 384 (e.g., a first lateral side) of the intermediate frame connector 348 and a second peripheral extension 386 extending from a second side 388 (e.g., a second lateral side), opposite the first side 384, of the intermediate frame connector 348. The peripheral extensions 382, 386 may be configured to couple to respective peripheral frame segments 350. For example, each of the peripheral frame segments 350 may include (e.g., define) a first opening, space, or passage 390 extending therethrough, and the peripheral extensions 382, 386 may be inserted into the respective first openings 390 of the peripheral frame segments 350. In some embodiments, the peripheral extensions 382, 386 may have a geometry, shape, and/or dimension corresponding to at least a portion of a geometry, shape, or dimension of the peripheral frame segments 350 and/or the first openings 390. Additionally, first holes 392 may be formed through the peripheral extensions 382, 386. In an assembled configuration of the frame structure 304, in which the peripheral extensions 382, 386 are inserted into the first openings 390 of the peripheral frame segments 350, the first holes 392 of the peripheral extensions 382, 386 may align with second holes 394 formed in the peripheral frame segments 350. Mechanical fasteners (not shown), such as bolts, rivets, and the like, may be inserted through the aligned holes 392, 394 to bias the peripheral extensions 382, 386 and the respective peripheral frame segments 350 against one another. Thus, the mechanical fasteners may secure the first peripheral extension 382 to one of the peripheral frame segments 350 and the second peripheral extension 386 to another of the peripheral frame segments 350, thereby coupling the peripheral frame segments 350 to the intermediate frame connector 348.

The bracket 380 of the intermediate frame connector 348 may also include a first intermediate extension 396 extending from a third side 398 of the intermediate frame connector 348 and a second intermediate extension 400 extending from a fourth side 402, opposite the third side 398, of the intermediate frame connector 348. The first intermediate extension 396 may be configured to couple to the first intermediate frame segment 340, and the second intermediate extension 400 may be configured to couple to the second intermediate frame segment 342. As an example, the first intermediate frame segment 340 may form a second opening, space, or channel 404 extending therethrough, and the first intermediate extension 396 may be inserted into the second opening 404. Additionally, third holes 406 may be formed through the first intermediate extension 396, and fourth holes 408 may be formed through the first intermediate frame segment 340. The third holes 406 and the fourth holes 408 may align with one another in the assembled configuration, and mechanical fasteners may be inserted through the aligned holes 406, 408 to bias the first intermediate frame segment 340 and the first intermediate extension 396 against one another, thereby securing the first intermediate frame segment 340 to the intermediate frame connector 348. Furthermore, the second intermediate frame segment 342 may form a third opening, space, or channel 410 extending therethrough, and the second intermediate extension 400 may be inserted into the third opening 410. Fifth holes 412 may be formed through the second intermediate extension 400, and sixth holes 414 may be formed through the second intermediate frame segment 342. The fifth holes 412 and the sixth holes 414 may align with one another in the assembled configuration, and mechanical fasteners may be inserted through the aligned holes 406, 408 to bias the second intermediate frame segment 342 and the second intermediate extension 400 against one another, thereby securing the second intermediate frame segment 342 to the intermediate frame connector 348.

In certain embodiments, the intermediate frame connector 348 may also include seventh holes 416 formed on the peripheral extensions 382, 386 (e.g., on a respective surface that is oriented crosswise with respect to the corresponding surfaces on which the first holes 392 are formed). The seventh holes 416 may also enable the peripheral frame segments 350 to be coupled to the intermediate frame connector 348, such as for a different relative orientation between the intermediate frame connector 348 and the peripheral frame segments 350. By way of example, the intermediate frame connector 348 may be arranged in a different manner at another location on the intermediate frame assembly 336. For instance, in another position and orientation of the intermediate frame connector 348, the first holes 392 may be occluded (e.g., by a base of the HVAC system 300 or housing 302) and the seventh holes 416 may be exposed. For this reason, at such a position and orientation of the intermediate frame connector 348, it may not be desirable to arrange the peripheral frame segments 350 in a manner that enables the second holes 394 of the peripheral frame segments 350 to align with the first holes 392 of the peripheral extensions 382, 386 in the assembled configuration. Instead, the peripheral frame segments 350 may be oriented to enable the second holes 394 of the peripheral frame segments 350 to align with the seventh holes 416 of the peripheral extensions 382, 386 to facilitate insertion of the mechanical fasteners through the aligned holes 394, 416 to couple the peripheral frame segments 350 to the intermediate frame connector 348. Forming the first holes 392 and the seventh holes 416 through each of the peripheral extensions 382, 386 may enable flexible and selectable orientation and positioning of the intermediate frame connector 348 during assembly the frame structure 304. As an example, a single embodiment of the intermediate frame connector 348 may be manufactured and incorporated in any suitable manner (e.g., any position, any orientation) within the intermediate frame assembly 336, and the peripheral frame segments 350 may be coupled to any of the intermediate frame connectors 348.

In some embodiments, the intermediate frame connector 348 may include a shroud 418 (e.g., shroud portion, cover portion) configured to couple to the bracket 380 (e.g., to exterior surfaces of the bracket 380). As an example, the shroud 418 may be coupled to the bracket 380 via a mechanical fastener, an adhesive, a punch, a weld, another suitable feature, or any combination thereof. The shroud 418 may be configured to provide a sealing interface for the intermediate frame connector 348. For instance, in the assembled configuration, each of the frame segments 340, 342, 350 may be configured to engage the shroud 418. Indeed, respective edges of the frame segments 340, 342, 350 may be configured to abut corresponding edges of the shroud 418. Thus, the shroud 418 may occlude gaps formed between the frame segments 340, 342, 350 and/or the bracket 380 in the assembled configuration, thereby blocking air from flowing between an exterior and an interior of the housing 302. In this way, the shroud 418 may enable the HVAC system 300 to operate more efficiently.

Additionally, port holes 420 may be formed through the bracket 380 and/or the shroud 418. The port holes 420 may enable material to be injected or inserted through the intermediate frame connector 348, and the material may flow from the intermediate frame connector 348 and into the openings 390, 404, 410 to fill the frame segments 340, 342, 350 in the assembled configuration. For example, the material may include an insulating material that limits heat transfer between the interior of the housing 302 and the external environment. Thus, the material may block an impact of a temperature of the external environment on the components disposed within the housing 302 and/or air flow directed through the housing 302 to enable the HVAC system 300 to operate more efficiently.

In the illustrated embodiment, the extensions 382, 386, 396, 400 of the intermediate frame connector 348 are oriented approximately perpendicularly relative to one another. In additional or alternative embodiments, the extensions 382, 386, 396, 400 may be oriented at different angles than depicted, such as at an oblique angle and/or at an approximately parallel angle. In further embodiments, the intermediate frame connector 348 may include a different number of extensions 382, 386, 396, 400 than depicted. Further still, although the illustrated intermediate frame connector 348 is configured to couple to the frame segments 340, 342, 350, the intermediate frame connector 348 may be configured to couple to different frame segments, such as to at least one of the intermediate frame segments 344, 346.

Figure 6:
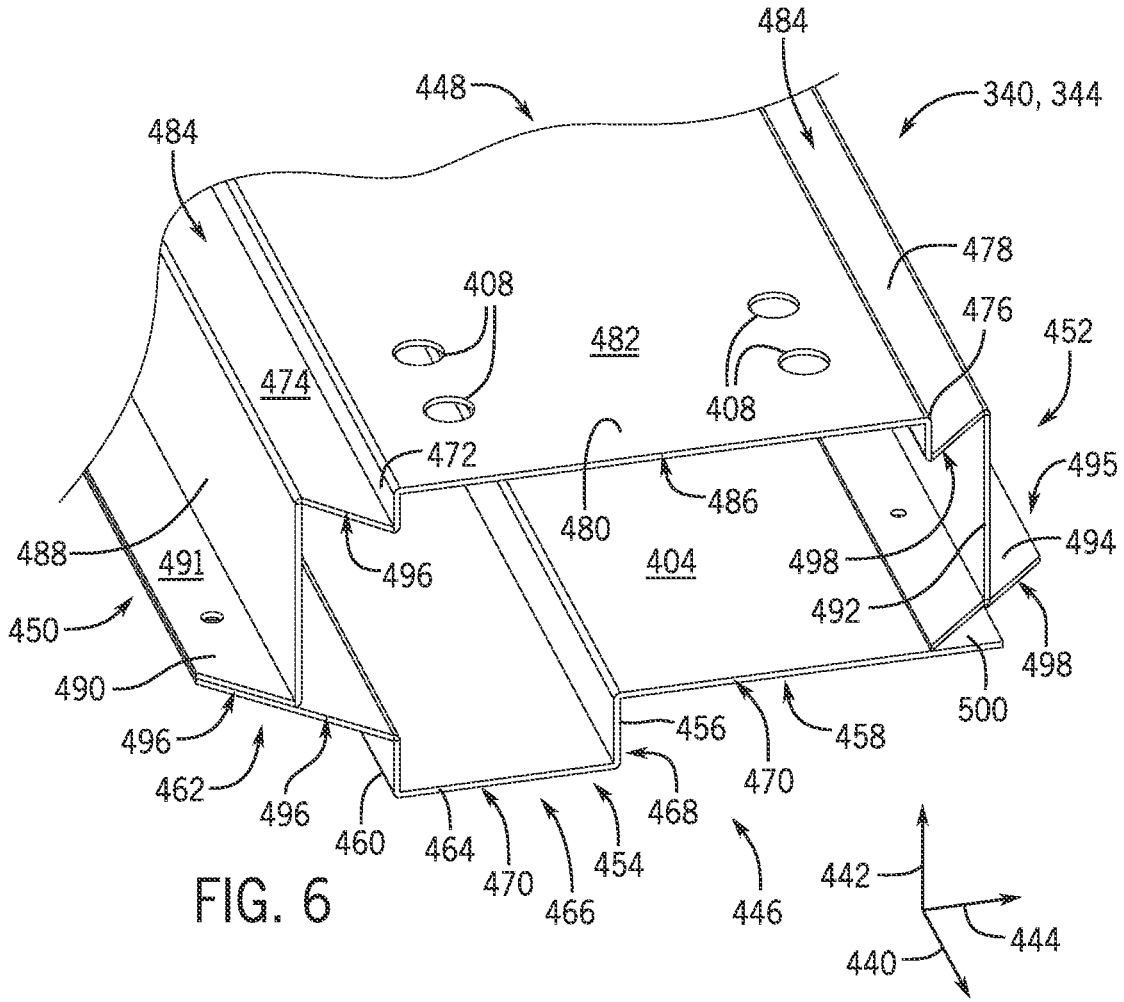
FIG. 6 is a detailed perspective view of an embodiment of a frame segment configured to be incorporated in a frame structure of a housing for an HVAC system, in accordance with an aspect of the present disclosure.

In some embodiments, the first intermediate frame segment 340 and the third intermediate frame segment 344 may have a common profile, shape, configuration, and/or geometry. That is, the intermediate frame segments 340, 344 may be of a single embodiment or design. FIG. 6 is a detailed perspective view of an embodiment of the intermediate frame segment 340, 344 (e.g., horizontal intermediate frame segment). To facilitate discussion, the intermediate frame segment 340, 344 will be described with reference to a longitudinal axis or direction 440, a vertical axis or direction 442, and a lateral axis or direction 444 with respect to an orientation of the intermediate frame segment 340, 344. The intermediate frame segment 340, 344 may include an interior side 446, which may face an interior of the housing 302 in the assembled configuration of the frame structure 304. The intermediate frame segment 340, 344 may also include an exterior side 448, which may face an exterior of the housing 302 and/or an environment surrounding the housing 302 in the assembled configuration. The intermediate frame segment 340, 344 may further include a first lateral side 450 and a second lateral side 452.

A protrusion 454 may be formed at the interior side 446 of the intermediate frame segment 340, 344. The protrusion 454 may include a first protrusion portion 456 extending from a first interior surface 458, a second protrusion portion 460 extending from a second interior surface 462, and a third protrusion portion 464 extending between the first and second protrusion portions 456, 460. Thus, the first protrusion portion 456 and the second protrusion portion 460 may offset an interior protrusion surface 466 of the third protrusion portion 464 from the first interior surface 458 and the second interior surface 462. The protrusion 454 may be configured to couple to a panel, such as the interior panel, in the assembled configuration of the frame structure 304. By way of example, an end of the panel may be configured to couple (e.g., mount) to a lateral protrusion surface 468 of the first protrusion portion 456 of one of the intermediate frame segments 340, 344 (e.g., via mechanical fasteners). An opposite end of the panel may be configured to couple (e.g., mount) to a corresponding lateral protrusion surface 468 of the first protrusion portion 456 of another of the intermediate frame segments 340, 344 (e.g., disposed at an opposite side of the frame structure 304). In other words, the respective lateral protrusion surfaces 468 of the intermediate frame segments 340, 344 may couple to opposite ends of the panel. Additionally, an interior edge 470 extending along the protrusion 454 (e.g., along the protrusion portions 456, 460, 464) and along the first interior surface 458 may engage a corresponding edge of one of the intermediate frame segments 342, 346 in the assembled configuration. Thus, air may be blocked from flowing between the assembled intermediate frame segments 340, 342, 344, 346 (e.g., to block air from flowing between an interior and an exterior of the housing 302).

The exterior side 448 of the intermediate frame segment 340, 344 may include a first exterior portion 472 extending from a first exterior surface 474, a second exterior portion 476 extending from a second exterior surface 478, and a third exterior portion 480 extending between the first and second exterior portions 472, 476. Thus, the first exterior portion 472 and the second exterior portion 476 may offset a third exterior surface 482 from the first exterior surface 474 and the second exterior surface 478. In this manner, the orientation of the exterior portions 472, 476, 480 relative to the exterior surfaces 474, 478 may form recesses 484 at the exterior side 448 and extending along opposite lateral sides 450, 452 (e.g., along the longitudinal axis 440). In the assembled configuration, each of the recesses 484 may be configured to receive at least a portion of one of the housing panels 310. For example, the first exterior surface 474 and the second exterior surface 478 may be configured to couple to separate housing panels 310 (e.g., via mechanical fasteners). In some embodiments, each of the exterior surfaces 474, 478 may generally extend along a plane formed by the longitudinal axis 440 and the lateral axis 444 and may therefore be oriented crosswise to the vertical axis 442 and/or the lateral protrusion surface 468. As such, the housing panels 310 disposed at least partially within the recesses 484 may be oriented crosswise to the panel (e.g., interior panel) coupled to the protrusion 454. Additionally, the fourth holes 408 may be formed through the third exterior portion 480 to enable the third exterior portion 480 to be coupled to the intermediate frame connector 348 (e.g., the first intermediate extension 396) in the assembled configuration. In the assembled configuration, an exterior edge 486 extending along the exterior portions 472, 476, 480 may engage the shroud 418 of the intermediate frame connector 348 and/or corresponding edges of the peripheral frame segments 350, thereby providing a sealing interface therebetween to block air from flowing between the intermediate frame segments 340, 344, the peripheral frame segments 350, and the intermediate frame connector 348.

The first lateral side 450 may include a first lateral portion 488 extending between the first exterior surface 474 and the second interior surface 462. In the illustrated embodiment, a first flange 490 extends beyond (e.g., outwardly from, relative to the second opening 404) the first lateral portion 488 along the lateral axis 444. The first flange 490 may be configured to engage a corresponding flange of a peripheral frame segment 350 (e.g., a peripheral frame segment 350 engaging the first lateral side 450 of the intermediate frame segment 340, 344) in the assembled configuration, further blocking air from flowing between the intermediate frame segment 340, 344 and the peripheral frame segment 350 at the first lateral side 450. In certain embodiments, a first flange surface 491 of the first flange 490 may be configured to engage with another component of the HVAC system 300 and/or housing 302 in the assembled configuration, such as one of the housing panels 310, a base panel, a cover, or any other suitable component. The second lateral side 452 may include a second lateral portion 492 extending between the first interior surface 458 and the second exterior surface 478. A second flange 494 may extend beyond (e.g., outwardly from, relative to the second opening 404) the second lateral portion 492 along the lateral axis 444. The second flange 494 may be configured to engage a corresponding flange of an additional peripheral frame segment 350 (e.g., a peripheral frame segment 350 engaging the second lateral side 452 of the intermediate frame segment 340, 344) in the assembled configuration, further blocking air from flowing between the intermediate frame segment 340, 344 and the additional peripheral frame segment 350 at the second lateral side 452. A second flange surface 495 of the second flange 494 may be configured to engage another component of the HVAC system 300 and/or housing 302 in the assembled configuration, as similarly described above.

In the illustrated embodiment, first lateral edges 496 (e.g., first interior edges) extending (e.g., from the interior edge 470, from the exterior edge 486) along the first exterior surface 474, the second interior surface 462, and the first flange 490 may be angled obliquely relative to the lateral axis 444. In this way, the first lateral edges 496 may be configured to receive and engage with corresponding angled edges of the peripheral frame segment 350 engaging the first lateral side 450 of the intermediate frame segment 340, 344. Similarly, second lateral edges 498 (e.g., second interior edges) extending along the second exterior surface 478 and the second flange 494 may be angled obliquely relative to the lateral axis 444. Thus, the second lateral edges 498 may be configured to receive and engage corresponding angled edges of the peripheral frame segment 350 engaging the second lateral side 452 of the intermediate frame segment 340, 344.

The intermediate frame segment 340, 344 may also include a projection 500 extending from the second lateral portion 492 and the second flange 494 at the interior side 446 and in a direction that is at least partially along the longitudinal axis 440. That is, the projection 500 may be oriented obliquely relative to the second lateral edges 498. In the assembled configuration, the projection 500 may extend at least partially into the first opening 390 of the peripheral frame segment 350 engaging the second lateral side 452 of the intermediate frame segment 340, 344 and may engage a surface of the peripheral frame segment 350 located within the first opening 390. In this way, the projection 500 may further block air from flowing between the intermediate frame segment 340, 344 and the peripheral frame segment 350. The projection 500 may also increase securement between the intermediate frame segment 340, 344 and the peripheral frame segment 350. For instance, the projection 500 may block certain relative movement between the intermediate frame segment 340, 344 and the peripheral frame segment 350 (e.g., along the vertical axis 442). Although the illustrated projection 500 has a rectangular shape, an additional or alternative projection 500 may include any suitable geometry, such as a triangular shape, a curved shape, a wavy shape, and so forth.

Figure 7:
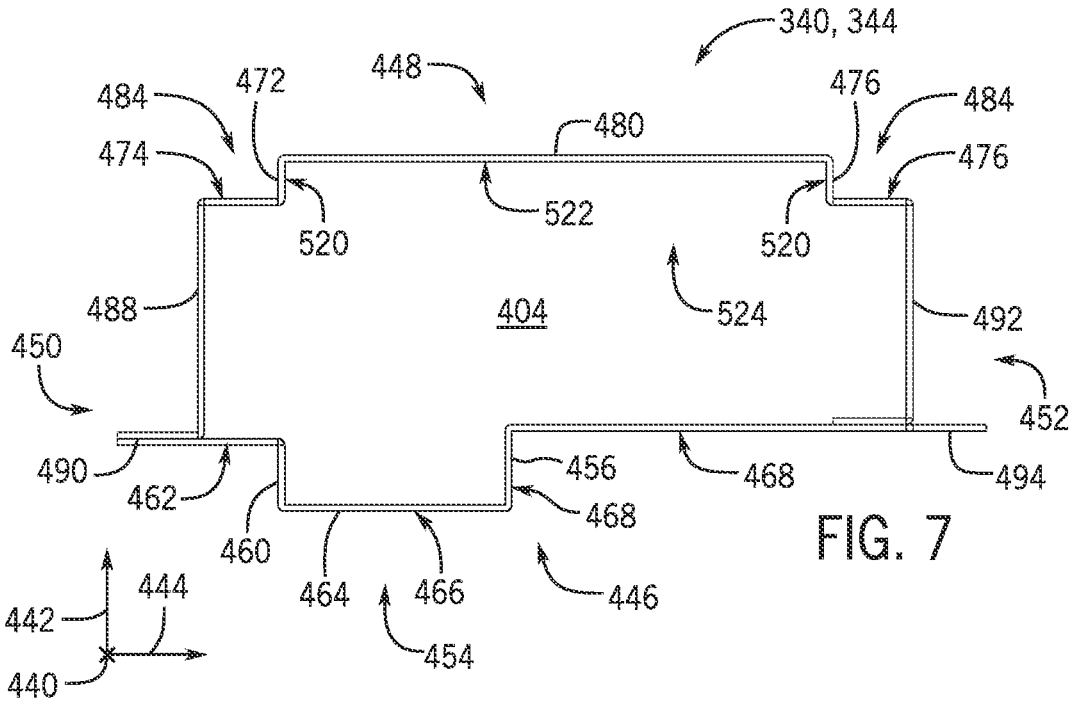
FIG. 7 is an axial view of an embodiment of a frame segment configured to be incorporated in a frame structure of a housing for an HVAC system, in accordance with an aspect of the present disclosure.

FIG. 7 is an axial view of an embodiment of the intermediate frame segment 340, 344. Each of the first exterior portion 472 and the second exterior portion 476 may include a respective first inward facing surface 520 (e.g., a lateral inward facing surface that is exposed to the second opening 404). Additionally, the third exterior portion 480 may include a second inward facing surface 522 (e.g., a surface that is exposed to the second opening 404 and extends between the first inward facing surfaces 520). In the assembled configuration, each of the first inward facing surfaces 520 and the second inward facing surface 522 may be configured to engage a portion of the intermediate frame connector 348. For example, the inward facing surfaces 520, 522 may form a channel 524 in the second opening 404 at the exterior side 448. The channel 524 may capture the first intermediate extension 396 to block relative movement between the intermediate frame segment 340, 344 and the intermediate frame connector 348.

In the illustrated embodiment, a length of the first protrusion portion 456 is greater than a length of the second protrusion portion 460. That is, with respect to the vertical axis 442, an offset (e.g., dimension) between the third interior protrusion surface 466 and the first interior surface 458 may be greater than an offset (e.g., dimension) between the third protrusion surface 466 and the second interior surface 462. Thus, the first interior surface 458 may be offset from the second interior surface 462 relative to the vertical axis 442. For example, the offset between the interior surfaces 458, 462 may enable the projection 500 extending from the second lateral portion 492 to be positioned within the first opening 390 of the peripheral frame segment 350 engaging the second lateral side 452 of the intermediate frame segment 340, 344.

Figure 8:
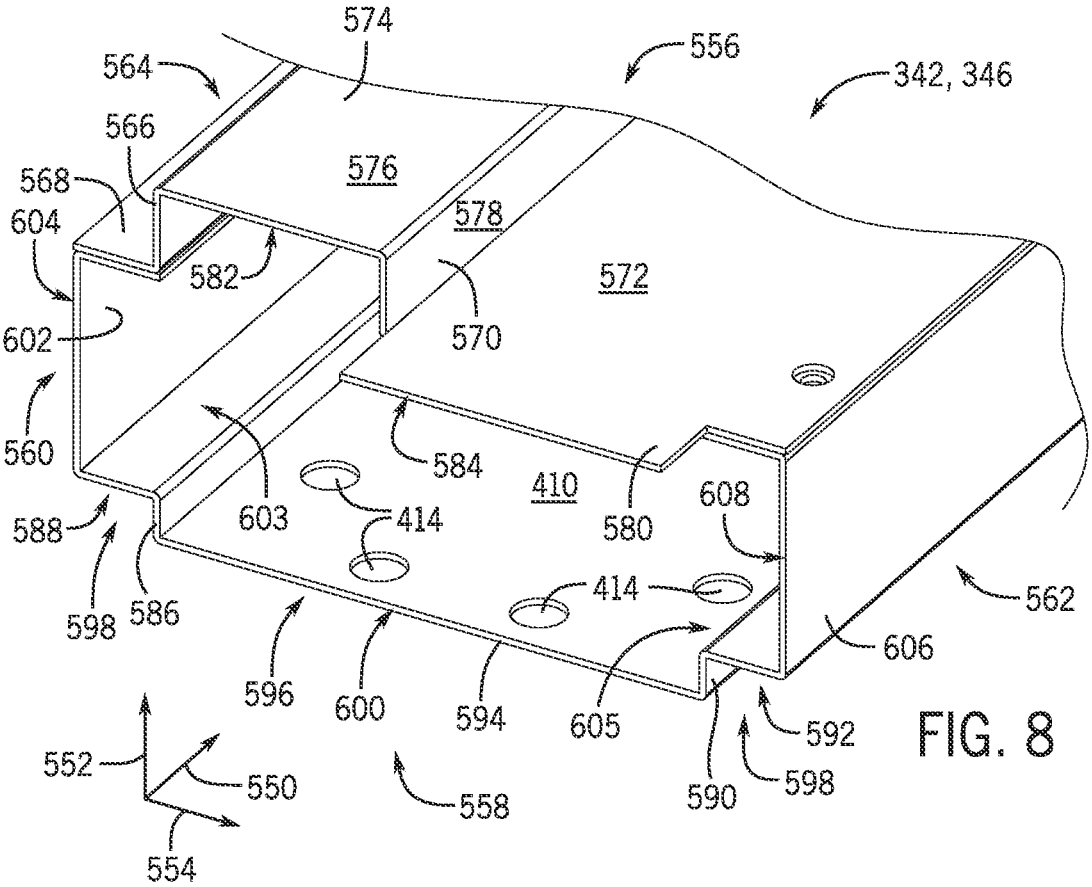
FIG. 8 is a detailed perspective view of an embodiment of a frame segment configured to be incorporated in a frame structure of a housing for an HVAC system, in accordance with an aspect of the present disclosure.

Furthermore, in certain embodiments, the second intermediate frame segment 342 and the fourth intermediate frame segment 346 may have generally the same profile. Indeed, the intermediate frame segments 342, 346 may be of a single embodiment that is different than that of the first and second intermediate frame segments 340, 344. FIG. 8 is a detailed perspective view of an embodiment of the intermediate frame segment 342, 346 (e.g., vertical frame segment). To facilitate discussion, the intermediate frame segment 342, 346 will be described with reference to a longitudinal axis or direction 550, a vertical axis or direction 552, and a lateral axis or direction 554 with respect to an orientation of the intermediate frame segment 342, 346. The intermediate frame segment 342, 346 may include an interior side 556, which may face an interior of the housing 302 in the assembled configuration, and an exterior side 558, which may face an exterior of the housing 302 in the assembled configuration. The intermediate frame segment 342, 346 may also include a first lateral side 560 and a second lateral side 562.

A protrusion 564 may be formed at the interior side 556. The protrusion 564 may include a first protrusion portion 566 extending from a first interior surface 568, a second protrusion portion 570 extending from a second interior surface 572, and a third protrusion portion 574 extending between the first and second protrusion portions 566, 570. The first protrusion portion 566 and the second protrusion portion 570 may offset an interior protrusion surface 576 of the third protrusion portion 574 from the first interior surface 568 and the second interior surface 572. The protrusion 564 may be configured to couple to a panel, such as the interior panel that is also coupled to the protrusion 454 of the intermediate frame segment 340, 344, in the assembled configuration. Indeed, the second protrusion portion 570 may include a lateral protrusion surface 578 configured to couple (e.g., mount) to an end of the panel. Additionally, an opposite end of the panel may be configured to couple to a corresponding lateral protrusion surface 578 of the first protrusion portion 566 of another of the intermediate frame segments 342, 346. Thus, respective lateral protrusion surfaces 578 of the intermediate frame segments 342, 346 may couple to opposite ends of the panel. The interior side 556 may also include an extended portion 580, which may extend beyond a remainder of intermediate frame segment 342, 346 along the longitudinal axis 550. That is, with respect to the longitudinal axis 550, a first interior edge 582 extending along the protrusion 564 (e.g., along the protrusion portions 566, 570, 574) may be offset from a second interior edge 584 extending along the extended portion 580. In the assembled configuration, each of the interior edges 582, 584 may engage one of the intermediate frame segments 340, 344 (e.g., horizontal intermediate frame segments). For example, the first interior edge 582 of the intermediate frame segment 342, 346 may engage the interior protrusion surface 466 of the intermediate frame segment 340, 344, and the second interior edge 584 of the intermediate frame segment 342, 346 may engage the first interior surface 458 of the intermediate frame segment 340, 344, thereby blocking air from flowing between the assembled intermediate frame segments 340, 342, 344, 346.

The exterior side 558 of the intermediate frame segment 342, 346 may include a first exterior portion 586 extending from a first exterior surface 588, a second exterior portion 590 extending from a second exterior surface 592, and a third exterior portion 594 extending between the first and second exterior portions 586, 590. Thus, the first exterior portion 586 and the second exterior portion 590 may offset a third exterior surface 596 from the first exterior surface 588 and the second exterior surface 592. The orientation of the exterior portions 586, 590, 594 relative to the exterior surfaces 588, 592 may form recesses 598 at the exterior side 558 and extending along the opposing lateral sides 560, 562 (e.g., along the longitudinal axis 550). In the assembled configuration, each of the recesses 598 may be configured to receive (e.g., accommodate) one of the housing panels 310, which may couple to the exterior surfaces 588, 592, for example. For instance, the exterior surfaces 588, 592 may be oriented crosswise to the lateral protrusion surface 578. Thus, the housing panels 310 at least partially disposed within the recesses 598 may be oriented crosswise to the panel (e.g., interior panel) coupled to the protrusion 564. Furthermore, the sixth holes 414 may be formed through the third exterior portion 594 to enable the third exterior portion 594 to be coupled to the intermediate frame connector 348 (e.g., the second intermediate extension 400) in the assembled configuration. Further still, in the assembled configuration, an exterior edge 600 extending along the exterior portions 586, 590, 594 may engage the shroud 418 of the intermediate frame connector 348 and/or corresponding edges of the peripheral frame segments 350, thereby blocking air from flowing between the intermediate frame segments 342, 346, the peripheral frame segments 350, and the intermediate frame connector 348.

The first lateral side 560 may include a first lateral portion 602 extending between the first interior surface 568 and the first exterior surface 588 to form a first lateral channel 603 within the third opening 410 of the intermediate frame segment 342, 346. A first lateral edge 604 extending along the first lateral channel 603 may engage the peripheral frame segment 350 positioned at the first lateral side 560 of the intermediate frame segment 342, 346. The second lateral side 562 may include a second lateral portion 606 extending between the second interior surface 572 and the second exterior surface 592 to form a second lateral channel 605 within the third opening 410 of the intermediate frame segment 342, 346. A second lateral edge 608 extending along the second lateral channel 605 may engage the peripheral frame segment 350 positioned at the second lateral side 562 of the intermediate frame segment 342, 346. Thus, the lateral portions 602, 606 may further block air from flowing between the intermediate frame segment 342, 346 and the peripheral frame segments 350. The lateral portions 602, 606 may also block relative movement between the intermediate frame segment 342, 346 and the peripheral frame segments 350.

Figure 9:
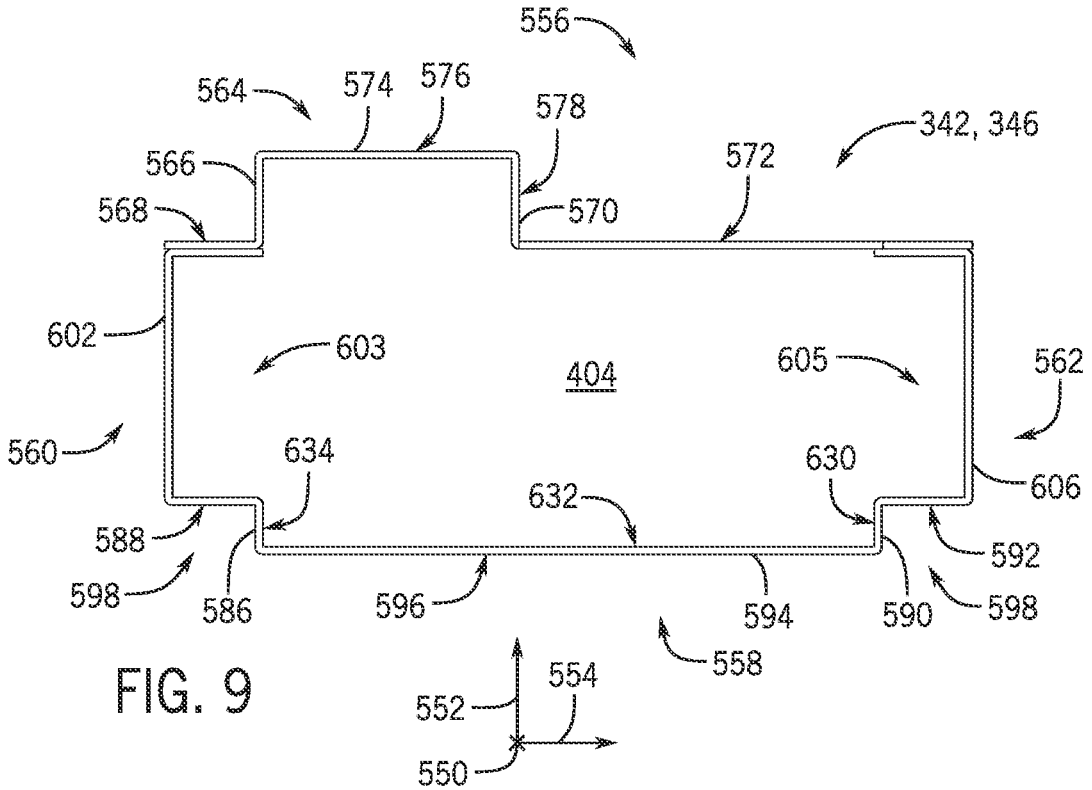
FIG. 9 is an axial view of an embodiment of a frame segment configured to be incorporated in a frame structure of a housing for an HVAC system, in accordance with an aspect of the present disclosure.

FIG. 9 is an axial view of an embodiment of the intermediate frame segment 342, 346. Each of the first exterior portion 586 and the second exterior portion 590 may include a respective first inward facing surface 630 (e.g., a lateral inward facing surface that is exposed to the third opening 410). Additionally, the third exterior portion 594 may include a second inward facing surface 632 (e.g., a surface that is exposed to the third opening 410 and extends between the first inward facing surfaces 630). In the assembled configuration, each of the first inward facing surfaces 630 and the second inward facing surface 632 may be configured to engage a portion of the intermediate frame connector 348. By way of example, the inward facing surfaces 630, 632 may form a channel 634 in the third opening 410 at the exterior side 558. The channel 634 may capture the second intermediate extension 400 to block relative movement between the intermediate frame segment 342, 346 and the intermediate frame connector 348.

Figure 10:
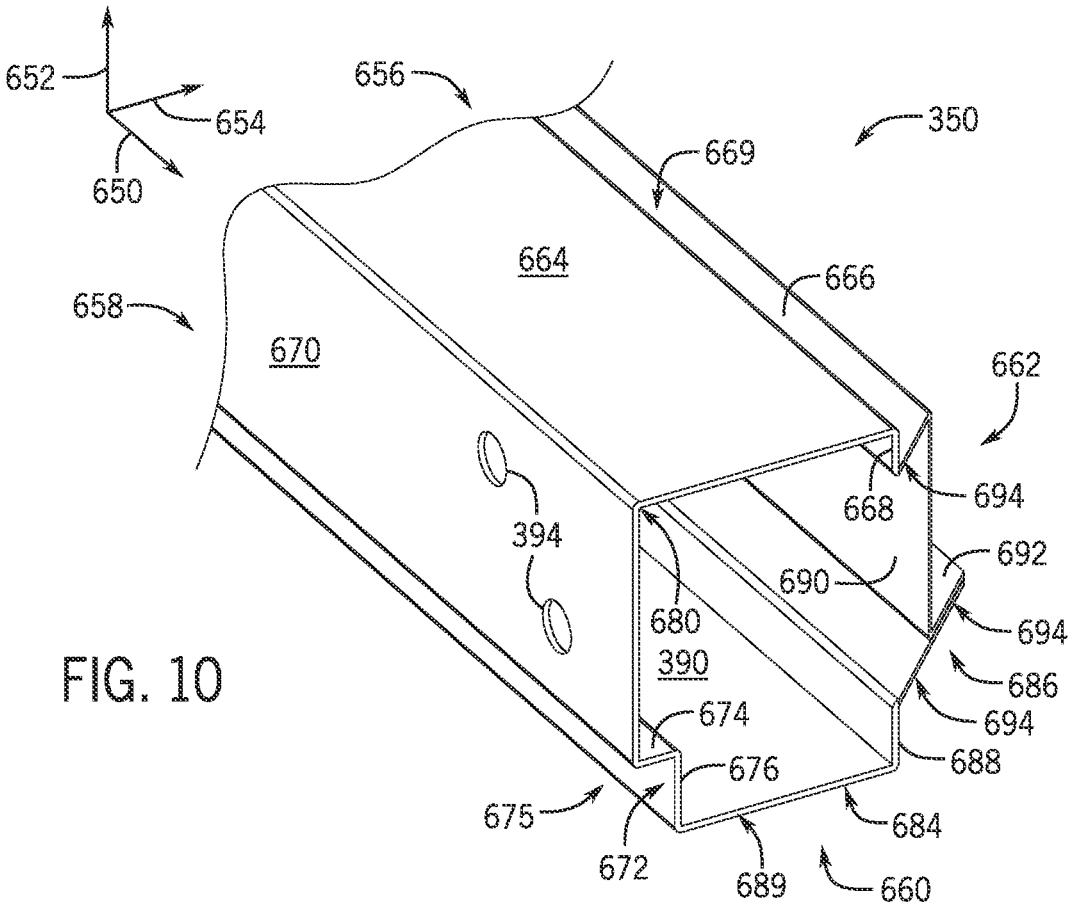
FIG. 10 is a detailed perspective view of an embodiment of a frame segment configured to be incorporated in a frame structure of a housing for an HVAC system, in accordance with an aspect of the present disclosure.

In some embodiments, each of the peripheral frame segments 350 may have a common profile and be of the same embodiment. FIG. 10 is a detailed perspective view of an embodiment of the peripheral frame segment 350. To facilitate discussion, the peripheral frame segment 350 will be described with reference to a longitudinal axis or direction 650, a vertical axis or direction 652, and a lateral axis or direction 654 with respect to an orientation of the peripheral frame segment 350. The peripheral frame segment 350 may include a first side 656 (e.g., a first exterior side), a second side 658 (e.g., a second exterior side), a third side 660 (e.g., a first interior side), and a fourth side 662 (e.g., a second interior side).

The first side 656 may include a first surface 664, a second surface 666, and a first portion 668 that offsets the first surface 664 and the second surface 666 from one another along the vertical axis 652 to form a first recess 669. In the assembled configuration, the first recess 669 may be configured to at least partially receive one of the housing panels 310, which may be coupled to the second surface 666, and the first portion 668 may be configured to engage one of the exterior portions 472, 476 of the intermediate frame segments 340, 344. The second side 658 may include a third surface 670, a fourth surface 672, a second portion 674 that offsets the third surface 670 and the fourth surface 672 from one another along the lateral axis 654 to form a second recess 675, and a third portion 676 extending from the second portion 674. In the assembled configuration, the second recess 675 may receive one of the housing panels 310, which may be coupled to the fourth surface 672, for example. A first edge 680 extending along the first portion 668, the first surface 664, the third surface 670, the second portion 674, and the third portion 676 may engage the shroud 418 of the intermediate frame connector 348 in the assembled configuration, thereby blocking air from flowing between the intermediate frame connector 348 and the peripheral frame segment 350. Moreover, the second holes 394 may be formed through the third surface 670 to enable the peripheral frame segment 350 to be coupled to the intermediate frame connector 348.

The third side 660 may include a fifth surface 684, a sixth surface 686, and a fourth portion 688 that offsets the fifth surface 684 and the sixth surface 686 from one another along the vertical axis 652. In the assembled configuration, the fifth surface 684 may engage one of the intermediate frame segments 342, 346 (e.g., the first lateral edge 604, the second lateral edge 608), thereby blocking air from flowing between the peripheral frame segment 350 and the intermediate frame segments 342, 346. Additionally, in the assembled configuration, the fourth portion 688 may be configured to engage one of the extended portion 580 of the intermediate frame segments 342, 346 or the second protrusion portion 460 of the intermediate frame segments 340, 344. A portion of a second edge 689 extending along the fifth surface 684 and the fourth portion 688 may also engage the shroud 418 of the intermediate frame connector 348 in the assembled configuration, further blocking air from flowing between the intermediate frame connector 348 and the peripheral frame segment 350. The fourth side 662 may include a fifth portion 690 extending between the second surface 666 and the sixth surface 686. A flange 692 may extend beyond (e.g., outwardly from) the fifth portion 690 along the lateral axis 654. The flange 692 may be configured to engage a corresponding flange of another frame segment (e.g., the first flange 490 or the second flange 494 of the intermediate frame segment 340, 344).

Further, in the illustrated embodiment, third edges 694 (e.g., third interior edges) extending (e.g., from the first edge 680, from the second edge 689) along the second surface 666, the sixth surface 686, and the flange 692 may be angled obliquely relative to the lateral axis 654. Thus, the third edges 694 may be configured to receive corresponding angled edges of the intermediate frame segments 340, 344 (e.g., the first lateral edges 496, the second lateral edges 498). Moreover, the fifth portion 690 of the peripheral frame segment 350 may engage the first lateral portion 488 or the second lateral portion 492 of the intermediate frame segments 340, 344. Such interfaces between the peripheral frame segment 350 and the intermediate frame segments 340, 344 may block air from flowing between the peripheral frame segment 350 and the intermediate frame segments 340, 344.

Figure 11:
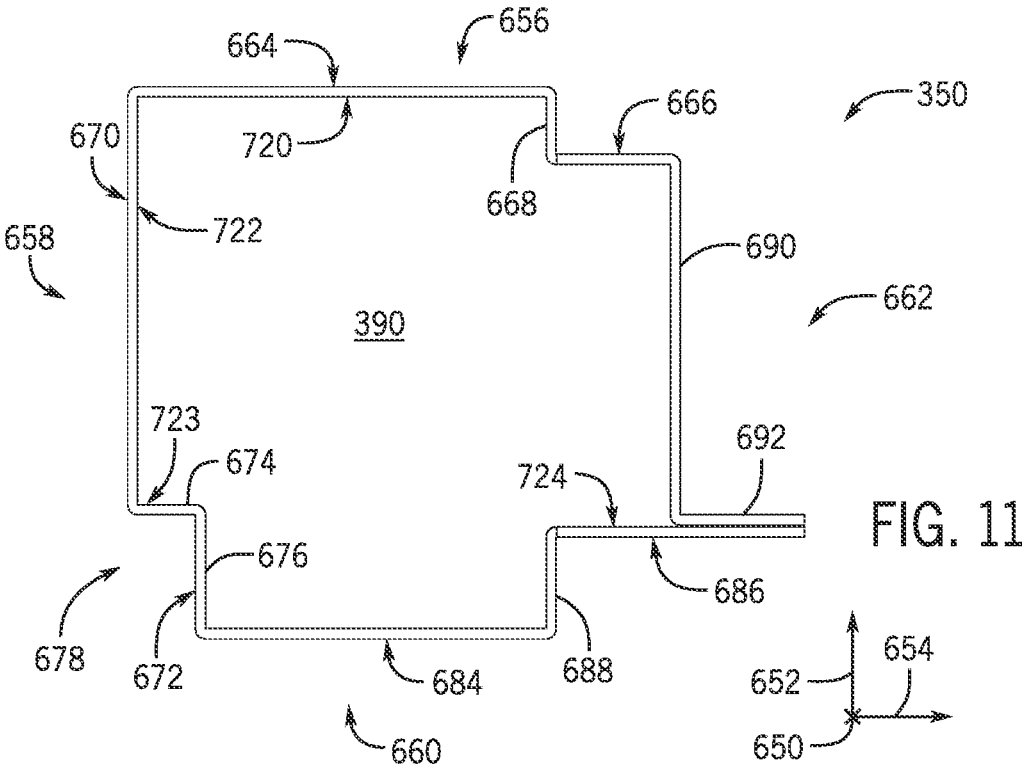
FIG. 11 is an axial view of an embodiment of a frame segment configured to be incorporated in a frame structure of a housing for an HVAC system, in accordance with an aspect of the present disclosure.

FIG. 11 is an axial view of an embodiment of the peripheral frame segment 350. The peripheral frame segment 350 may include a first inward facing surface 720 (e.g., opposite the first surface 664) and a second inward facing surface 722 (e.g., opposite the third surface 670). Each of the inward facing surfaces 720, 722 may be exposed to the first opening 390 and may be configured to engage a portion of the intermediate frame connector 348. For example, the inward facing surfaces 720, 722 may cooperatively capture one of the peripheral extensions 382, 386 to block relative movement between the peripheral frame segment 350 and the intermediate frame connector 348.

In the illustrated embodiment, a length of the third portion 676 is greater than a length of the fourth portion 688. That is, with respect to the vertical axis 652, an offset between the fifth surface 684 and a seventh surface 723 extending along the second portion 674 may be greater than an offset between the fifth surface 684 and the sixth surface 686. For example, the offset between the fifth surface 684 and the sixth surface 686 may enable the projection 500 of the intermediate frame segment 340, 344 to extend into the first opening 390, such as to engage the third inward facing surface 724 (e.g., opposite the sixth surface 686), in the assembled configuration.

Although each of the illustrated frame segments 340, 342, 344, 346, 350 includes rectangular features (e.g., portions that are oriented generally perpendicularly to one another), any of the frame segments 340, 342, 344, 346, 350 may have features of any other suitable geometry in additional or alternative embodiments. Moreover, in some embodiments, any of the intermediate frame segments 340, 342, 344, 346, 350 may include components that are separately manufactured (e.g., via metal bending, via extrusion) and are coupled to one another, such as via mechanical fasteners, adhesives, welding, brazing, and the like. In additional or alternative embodiments, any of the frame segments 340, 342, 344, 346, 350 may be formed from a single integral component (e.g., bending and cutting a single piece of material). Indeed, each of the frame segments 340, 342, 344, 346, 350 may be formed to contain insulation material injected into their respective openings 390, 404, 410, such as to provide sealed interfaces and/or boundaries that block the insulation material from being undesirably removed from an interior of the frame segments 340, 342, 344, 346, 350 (e.g., to the exterior of the housing 302). In other words, the openings 390, 404, 410 formed by the intermediate frame segments 340, 342, 344, 346, 350 may be sealed to contain the insulation material therein.

Figure 12:
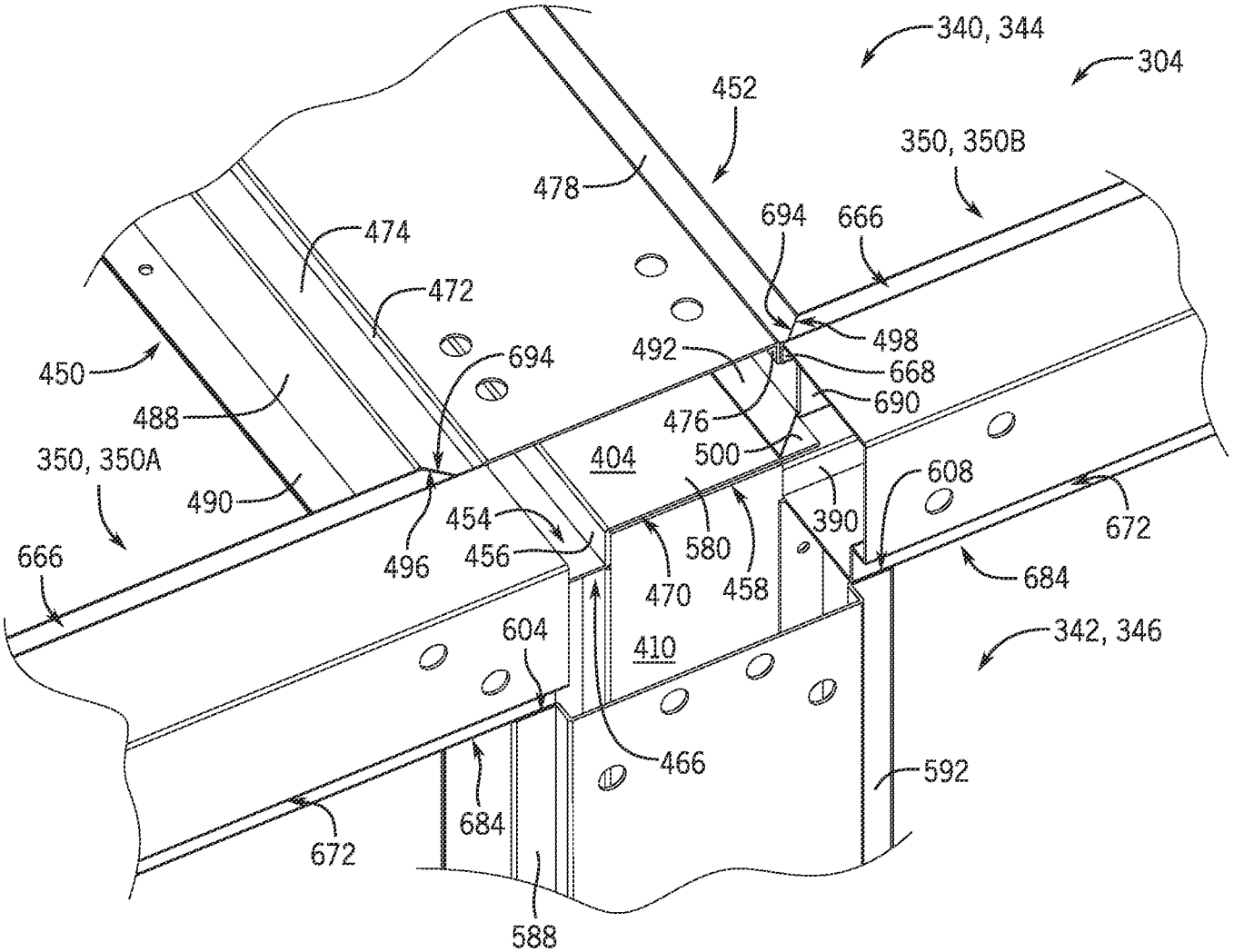
FIG. 12 is a detailed perspective view of an embodiment of a frame structure of a housing for an HVAC system, in accordance with an aspect of the present disclosure.

FIG. 12 is a detailed perspective view of an embodiment of the frame structure 304, illustrating two peripheral frame segments 350, one of the intermediate frame segments 340, 344 (e.g., horizontal intermediate frame segments), and one of the intermediate frame segments 342, 346 (e.g., vertical intermediate frame segments) coupled to one another. In the illustrated embodiment, the intermediate frame connector 348 is not shown to better illustrate engagement between the frame segments 340, 342, 344, 346, 350. The illustrated intermediate frame segment 340, 344 is engaged with a first peripheral frame segment 350A at the first lateral side 450 of the intermediate frame segment 340, 344. For instance, the first exterior portion 472 of the intermediate frame segment 340, 344 may be configured to engage with the first portion 668 (not shown) of the first peripheral frame segment 350A, the first lateral edges 496 of the intermediate frame segment 340, 344 may be configured to engage with the third edges 694 of the first peripheral frame segment 350A, the first lateral portion 488 of the intermediate frame segment 340, 344 may be configured to engage with the fifth portion 690 (not shown) of the first peripheral frame segment 350A, the first flange 490 of the intermediate frame segment 340, 344 may be configured to engage with the flange 692 (not shown) of the first peripheral frame segment 350A, and the second protrusion portion 460 (not shown) of the intermediate frame segment 340, 344 may be configured to engage with the fourth portion 688 (not shown) of the first peripheral frame segment 350A.

Additionally, the intermediate frame segment 340, 344 is engaged with a second peripheral frame segment 350B at the second lateral side 452 of the intermediate frame segment 340, 344. By way of example, the second exterior portion 476 of the intermediate frame segment 340, 344 may be configured to engage with the first portion 668 of the second peripheral frame segment 350B, the second lateral edges 498 of the intermediate frame segment 340, 344 may be configured to engage with the third edges 694 of the second peripheral frame segment 350B, the second lateral portion 492 of the intermediate frame segment 340, 344 may be configured to engage with the fifth portion 690 of the second peripheral frame segment 350B, the second flange 494 (not shown) of the intermediate frame segment 340, 344 may be configured to engage with the flange 692 (not shown) of the second peripheral frame segment 350B, and the projection 500 of the intermediate frame segment 340, 344 may be configured to insert into the first opening 390 and engage with the third inward facing surface 724 of the second peripheral frame segment 350B.

The intermediate frame segment 340, 344 is also engaged with the intermediate frame segment 342, 346. For instance, the protrusion 454 (e.g., the interior protrusion surface 466 of the intermediate frame segment 340, 344) may be configured to engage with the protrusion 564 (e.g., the first interior edge 582) of the intermediate frame segment 342, 346, and each of the first protrusion portion 456, the interior edge 470, and the first interior surface 458 of the intermediate frame segment 340, 344 may be configured to engage with the extended portion 580 of the intermediate frame segment 342, 346 (e.g., the second interior edge 584, the second interior surface 572). The intermediate frame segment 342, 346 is further engaged to the peripheral frame segments 350. As an example, the first lateral edge 604 of the intermediate frame segment 342, 346 may be configured to engage with the fifth surface 684 of the first peripheral frame segment 350A, and the second lateral edge 608 of the intermediate frame segment 342, 346 may be configured to engage with the fifth surface 684 of the second peripheral frame segment 350B.

Housing panels 310 may be positioned along various surfaces of the frame structure 304 in the illustrated embodiment. For instance, a respective housing panel 310 may be configured to be coupled to the interface formed by the first exterior surface 474 of the intermediate frame segment 340, 344 and the second surface 666 of the first peripheral frame segment 350A, the interface formed by the first flange 490 of the intermediate frame segment 340, 344 and the flange 692 of the first peripheral frame segment 350A, the interface formed by the second exterior surface 478 of the intermediate frame segment 340, 344 and the second surface 666 of the second peripheral frame segment 350B, the interface formed by the second flange 494 of the intermediate frame segment 340, 344 and the flange 692 of the second peripheral frame segment 350B, the interface formed by the first exterior surface 588 of the intermediate frame segment 342, 346 and the fourth surface 672 of the first peripheral frame segment 350A, and/or the interface formed by the second exterior surface 592 of the intermediate frame segment 342, 346 and the fourth surface 672 of the second peripheral frame segment 350B.

Figure 13:
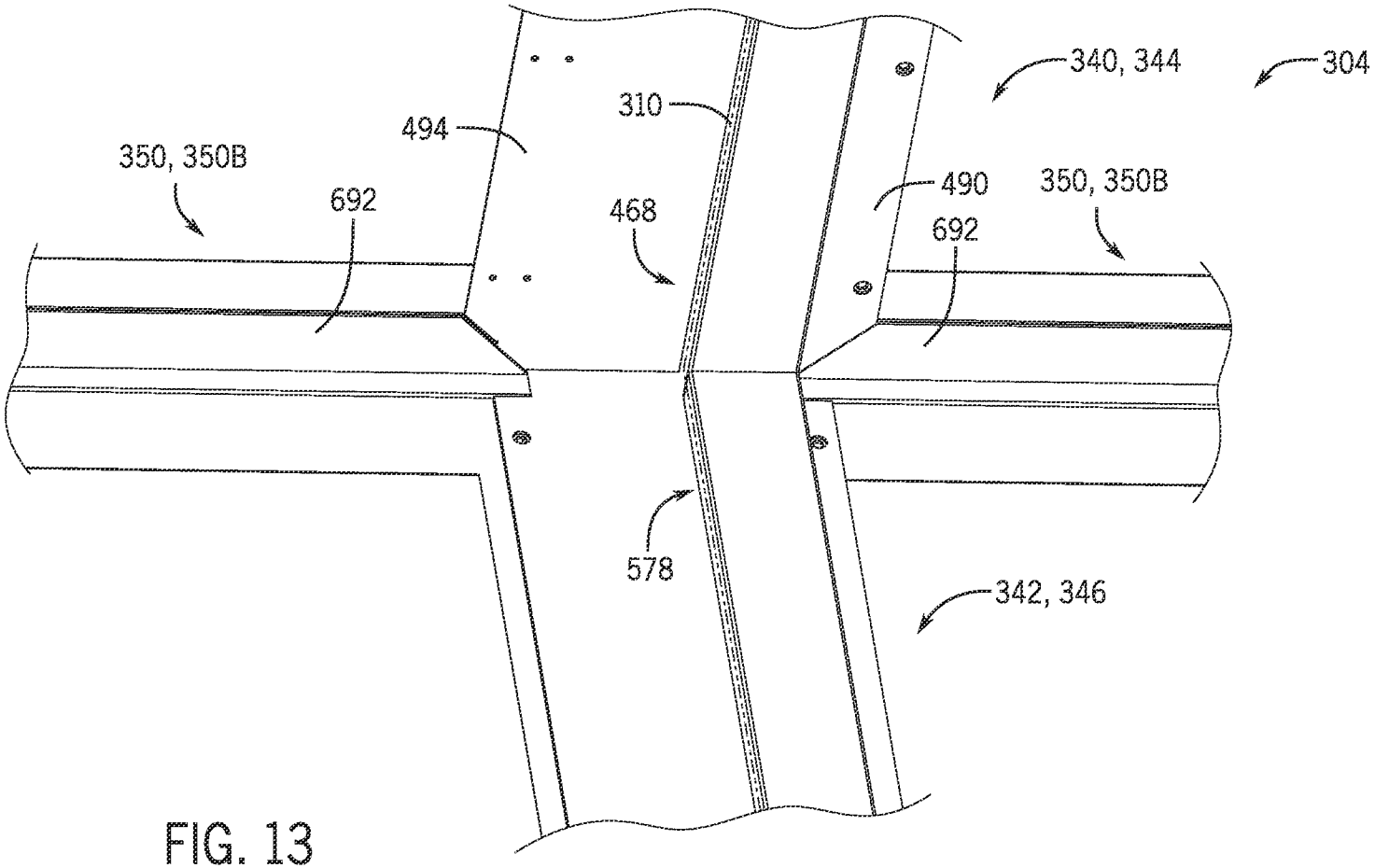
FIG. 13 is a detailed perspective view of an embodiment of a frame structure of a housing for an HVAC system, in accordance with an aspect of the present disclosure.

FIG. 13 is a detailed perspective view of an embodiment of the frame structure 304 at an interior of the housing 302. The illustrated frame structure 304 includes the two peripheral frame segments 350, one of the intermediate frame segments 340, 344 (e.g., horizontal intermediate frame segments), and one of the intermediate frame segments 342, 346 (e.g., vertical intermediate frame segments) coupled to one another. FIG. 13 more clearly illustrates the engagement between the first flange 490 of the intermediate frame segment 340, 344 and the flange 692 of the first peripheral frame segment 350A and the engagement between the second flange 494 of the intermediate frame segment 340, 344 and the flange 692 of the second peripheral frame segment 350B. The illustrated embodiment also includes an interface formed by the lateral protrusion surface 468 of the intermediate frame segment 340, 344 and the lateral protrusion surface 578 of the intermediate frame segment 342, 346. One of the housing panels 310 (shown in phantom lines), such as the interior panel, may be coupled to this interface in the assembled configuration.

FIG. 14 is a perspective view of an embodiment of the intermediate frame connector 348. To facilitate discussion, the intermediate frame connector 348 will be described with reference to a longitudinal axis 750, a vertical axis 752, and a lateral axis 754 with respect to an orientation of the intermediate frame connector 348. The illustrated intermediate frame connector 348 includes the bracket 380 having a first portion 756 and a second portion 758 that extend crosswise to one another. The first portion 756 may include the first intermediate extension 396 and may also form a part of the peripheral extensions 382, 386. The second portion 758 may include the second intermediate extension 400 and may also form a part of the peripheral extensions 382, 386. The first holes 392 may be formed in the peripheral extensions 382, 386 of the second intermediate extension 400, and the seventh holes 416 may be formed in the peripheral extensions 382, 386 of the first portion 756.

The first portion 756 may include a first base 760 extending along the lateral axis 754. A first end 762 of the first base 760 may form part of the first peripheral extension 382, and a second end 764, opposite the first end 762, of the first base 760 may form part of the second peripheral extension 386. A first support 766 may extend (e.g., along the vertical axis 752) from the first base 760 (e.g., a medial section of the first base 760) to form the first intermediate extension 396. Thus, the first base 760 and the first support 766 may collectively have a T-shaped geometry. Additionally, first flanges 768 may extend from the first support 766 (e.g., along the longitudinal axis 750). Each of the first support 766 and the first flanges 768 may be captured by one of the intermediate frame segments 340, 344 (e.g., within the second opening 404) to block movement between the intermediate frame connector 348 and the intermediate frame segment 340, 344. One of the port holes 420 may also be formed through a medial section of the first base 760.

The second portion 758 may include a second base 770 extending along the lateral axis 754 (e.g., along the first base 760). The second base 770 may be oriented crosswise to the first base 760. A third end 772 of the second base 770 may form another part of the first peripheral extension 382, and a fourth end 774, opposite the third end 772, may form another part of the second peripheral extension 386. A second support 776 may extend (e.g., along the longitudinal axis 750) from the second base 770 (e.g., a medial section of the second base 770) to form the second intermediate extension 400. As such, the second base 770 and the second support 776 may collectively have a T-shaped geometry. Second flanges 778 may extend from the second support 776 (e.g., along the vertical axis 752). Each of the second support 776 and the second flanges 778 may be captured by one of the intermediate frame segments 342, 346 (e.g., within the third opening 410), thereby blocking movement between the intermediate frame connector 348 and the intermediate frame segment 342, 346. Another of the port holes 420 may be formed through a medial section of the second base 770.

In certain embodiments, the portions 756, 758 may be integrally formed with one another. For instance, the portions 756, 758 may be formed from a single piece of material by cutting, metal bending, extrusion, and/or from multiple material pieces integrally secured to one another by welding or another joining technique. In additional or alternative embodiments, the portions 756, 758 may be separate components that are coupled to one another, such as via a mechanical fastener or adhesive.

The shroud 418 may be coupled to the bracket 380 along exterior surfaces 780 (e.g., surfaces that are exterior relative to an internal angle 782 formed between the bases 760, 770) of the first base 760, the first support 766, the second base 770, and the second support 776. For instance, a mechanical fastener, an adhesive, a weld, a punch, an interference fit, and/or any other suitable feature may be used to couple the shroud 418 to the bracket 380.

FIG. 15 is a perspective view of an embodiment of the frame structure 304 at an interior of the housing 302. The illustrated frame structure 304 includes one of the intermediate frame segments 340, 344, one of the intermediate frame segments 342, 346, and two peripheral frame segments 350. A portion of the intermediate frame segment 340, 344 and of the intermediate frame segment 342, 346 is not shown for visualization purposes. The intermediate frame connector 348 is coupled to each of the intermediate frame segment 340, 344, the intermediate frame segment 342, 346, and the peripheral frame segments 350. For example, the first peripheral extension 382 is configured to extend into the first opening 390 of the first peripheral segment 350A, the second peripheral extension 386 (not shown) is configured to extend into the first opening 390 of the second peripheral segment 350B, the first intermediate extension 396 is configured to extend into the second opening 404 of the intermediate frame segment 340, 344, and the second intermediate extension 400 is configured to extend into the third opening 410 of the intermediate frame segment 342, 346.

In the illustrated embodiment, one of the first flanges 768 of the first intermediate extension 396 is configured to abut the first inward facing surface 520 of the first exterior portion 472 of the intermediate frame segment 340, 344. The other of the first flanges 768 of the first intermediate extension 396 may abut the first inward facing surface 520 of the second exterior portion 476 of the intermediate frame segment 340, 344. Thus, the exterior portions 472, 476 may capture the first intermediate extension 396, thereby blocking movement between the intermediate frame segment 340, 344 and the intermediate frame connector 348. Furthermore, one of the second flanges 778 of the second intermediate extension 400 is configured to abut the first inward facing surface 630 of the first exterior portion 586 of the intermediate frame segment 342, 346, and the other of the second flanges 778 is configured to abut the first inward facing surface 630 of the second exterior portion 590 of the intermediate frame segment 342, 346. As such, the exterior portions 586, 590 may capture the second intermediate extension 400, thereby blocking movement between the intermediate frame segment 342, 346 and the intermediate frame connector 348.

In the assembled configuration, the frame segments 340, 342, 344, 346, 350 may be fluidly coupled to one another via the intermediate frame connector 348. Indeed, each of the openings 390, 404, 410 may be configured to receive material (e.g., insulation material) inserted through the port hole 420. Thus, the material inserted through the port hole 420 may be used to fill the openings 390, 404, 410 extending through the respective frame segments 340, 342, 344, 346, 350.

FIG. 16 is a perspective view of an embodiment of a frame structure 800 for the housing 302 of the HVAC system 300. The illustrated frame structure 800 includes four housing sections 802, 804, 806, 808. In some embodiments, the frame structure 800 may include multiple frame structures 304 described above coupled to one another. By way of example, a subset of the peripheral frame segments 350, the second intermediate frame segments 342, and the intermediate frame connector 348 of one of the frame structures 304 may be coupled to a subset of the peripheral frame segments 350, the second intermediate frame segments 342, and the intermediate frame connector 348 of another of the frame structures 304. For instance, a tie or bind (e.g., a cable tie), a mechanical fastener, an adhesive, a weld, another suitable feature, or any combination thereof may couple the components of the individual frame structures 304 to one another. Indeed, any suitable number of frame structures 304 may be coupled to one another to form the frame structure 800 having a desirable number of housing sections (e.g., more than four sections). In additional or alternative embodiments, different components may be used to create a frame structure having a desirable number of housing sections without coupling individual intermediate frame connectors 348 and/or peripheral frame segments 350 to one another. For example, a single intermediate frame connector may be configured to couple to multiple first intermediate frame segments 340, multiple second intermediate frame segments 342, multiple third intermediate frame segments 344, and/or multiple fourth intermediate frame segments 346, thereby enabling multiple intermediate frame assemblies 336 to be incorporated in the frame structure.

The present disclosure may provide one or more technical effects useful in an HVAC system. For example, the HVAC system may include a housing with a frame structure. In some embodiments, the frame structure may include an intermediate frame assembly that may be configured to couple multiple peripheral frame assemblies to one another. The intermediate frame assembly may include an intermediate frame connector configured to couple to multiple intermediate frame segments of the intermediate frame assembly and multiple peripheral frame segments of the respective peripheral frame assemblies. Each of the peripheral frame assemblies may define a respective housing section of the HVAC system with the intermediate frame assembly. Thus, the intermediate frame assembly may enable the frame structure to form multiple housing sections that are integral with or directly coupled to one another. Each housing section may be used for a different purpose associated with the HVAC system. As an example, one of the housing sections may contain components for operating a vapor-compression system of the HVAC system, and another housing section may be used to facilitate maintenance of the vapor-compression system. In this manner, the intermediate frame assembly may increase a functionality and/or improve manufacture of the HVAC system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A housing for a heating, ventilation, and/or air conditioning (HVAC) system, comprising:

a frame structure comprising a frame segment, wherein the frame segment comprises a protrusion formed on a first side of the frame segment, a first recess formed on a second side, opposite the first side, of the frame segment, and a second recess formed on the second side of the frame segment; and a plurality of housing panels, wherein a first housing panel of the plurality of housing panels is configured to directly couple to the protrusion of the frame segment, a second housing panel of the plurality of housing panels is configured to be disposed within the first recess of the frame segment, and a third housing panel of the plurality of housing panels is configured to be disposed within the second recess of the frame segment.

2. The housing of claim 1, wherein the frame structure comprises an additional frame segment, the additional frame segment comprises an additional protrusion formed on a third side of the additional frame segment, a third recess formed on a fourth side, opposite the third side, of the additional frame segment, and a fourth recess formed on the fourth side of the additional frame segment, wherein the first housing panel of the plurality of housing panels is configured to couple to the additional protrusion of the additional frame segment.

3. The housing of claim 1, wherein the first housing panel is oriented crosswise to the second housing panel and the third housing panel in an assembled configuration of the housing.

4. The housing of claim 1, wherein the frame segment defines an opening extending therethrough, the housing comprises a frame connector, and the frame connector comprises an extension configured to extend into the opening to couple the frame connector and the frame segment to one another in an assembled configuration of the housing.

5. The housing of claim 1, wherein the frame segment partially defines a first housing section and a second housing section of the housing, the first housing section is an air handling unit, and the second housing section is a vestibule.

6. The housing of claim 5, wherein the first housing panel is configured to extend between the first housing section and the second housing section in an assembled configuration of the housing.

7. The housing of claim 1, wherein the second side of the frame segment is an exterior side, the first recess extends along a first lateral side of the frame segment, and the second recess extends along a second lateral side, opposite the first lateral side, of the frame segment.

8. The housing of claim 1, wherein a surface of the protrusion is offset from an interior surface of the first side of the frame segment via a portion of the protrusion.

9. The housing of claim 1, wherein the first housing panel is configured to directly couple to a first surface of the protrusion, the second housing panel is configured to directly couple to a second surface of the first recess, and the third housing panel is configured to directly couple to a third surface of the second recess.

10. The housing of claim 9, wherein the first surface of the protrusion is oriented crosswise relative to the second surface of the first recess and the third surface of the second recess.

* * * * *